US009890485B2

(12) United States Patent
Podhajny

(10) Patent No.: US 9,890,485 B2
(45) Date of Patent: Feb. 13, 2018

(54) METHOD OF KNITTING A GUSSETED TONGUE FOR A KNITTED COMPONENT

(71) Applicant: NIKE, Inc., Beaverton, OR (US)

(72) Inventor: Daniel A. Podhajny, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 509 days.

(21) Appl. No.: 14/645,896

(22) Filed: Mar. 12, 2015

(65) Prior Publication Data

US 2015/0216255 A1 Aug. 6, 2015

Related U.S. Application Data

(63) Continuation of application No. 14/273,641, filed on May 9, 2014, now Pat. No. 9,003,836, which is a (Continued)

(51) Int. Cl.
*D04B 7/04* (2006.01)
*D04B 1/24* (2006.01)

(Continued)

(52) U.S. Cl.
CPC ..... *D04B 7/04* (2013.01); *A43B 1/04* (2013.01); *A43B 23/024* (2013.01);

(Continued)

(58) Field of Classification Search
CPC .... D04B 7/04; D04B 1/24; D04B 7/30; A43B 1/04; A43B 23/0245; A43B 23/04; A43B 23/26

(Continued)

(56) References Cited

U.S. PATENT DOCUMENTS 601,192 A 3/1898 Woodside
1,215,198 A 2/1917 Rothstein (Continued)

FOREIGN PATENT DOCUMENTS

CN 103556384 A 2/2014
DE 475363 C 4/1929

(Continued)

OTHER PUBLICATIONS

Declaration of Dr. Edward C. Frederick from the US Patent and Trademark Office Inter Partes Review of U.S. Pat. No. 7,347,011, 178 pages.

(Continued)

*Primary Examiner* — Danny Worrell
(74) *Attorney, Agent, or Firm* — Brinks Gilson & Lione

(57) ABSTRACT

A knitted component including a knit element and a gusseted tongue is incorporated into an upper of an article of footwear. The knit element defines a portion of an exterior surface of the upper and an opposite interior surface of the upper, with the interior surface defining a void for receiving a foot. The knit element and the gusseted tongue are formed together as a knitted component during a knitting process as a one-piece element. The gusseted tongue is formed of unitary knit construction with the knit element and is joined with the knit element in an instep area of the upper. The knitting process includes steps of forming portions of the knitted component, transferring portions of the knitted component to opposite needle beds, shifting needle beds along a lateral direction to cause portions to overlap, and joining the overlapped portions by knitting to form the gusseted tongue.

17 Claims, 18 Drawing Sheets

Related U.S. Application Data continuation of application No. 14/170,822, filed on Feb. 3, 2014, now Pat. No. 8,973,410.

(51) Int. Cl.

| | |
|---|---|
| ***A43B 23/04*** | (2006.01) |
| ***A43B 23/26*** | (2006.01) |
| ***D04B 1/22*** | (2006.01) |
| ***A43B 1/04*** | (2006.01) |
| ***A43B 23/02*** | (2006.01) |
| ***A43C 1/00*** | (2006.01) |
| ***A43C 1/04*** | (2006.01) |
| ***D04B 21/20*** | (2006.01) |

(52) U.S. Cl.

CPC ..... *A43B 23/0205* (2013.01); *A43B 23/0245* (2013.01); *A43B 23/04* (2013.01); *A43B 23/26* (2013.01); *A43C 1/00* (2013.01); *A43C 1/04* (2013.01); *D04B 1/22* (2013.01); *D04B 1/24* (2013.01); *D04B 21/207* (2013.01); *D10B 2403/032* (2013.01); *D10B 2501/043* (2013.01)

(58) Field of Classification Search

USPC ..... 66/64, 69

See application file for complete search history.

(56) References Cited

U.S. PATENT DOCUMENTS

| | | | | |
|---|---|---|---|---|
| 1,410,105 | A | | 3/1922 | Llewellyn |
| 1,597,934 | A | | 8/1926 | Stimpson |
| 1,888,172 | A | | 11/1932 | Joha |
| 1,902,780 | A | | 3/1933 | Holden et al. |
| 1,910,251 | A | | 5/1933 | Joha |
| 2,001,293 | A | | 5/1935 | Wilson |
| 2,047,724 | A | | 7/1936 | Zuckerman |
| 2,147,197 | A | | 2/1939 | Glidden |
| 2,314,098 | A | | 3/1943 | McDonald |
| 2,330,199 | A | | 9/1943 | Basch |
| 2,343,390 | A | | 3/1944 | Ushakoff |
| 2,400,692 | A | | 5/1946 | Herbert |
| 2,440,393 | A | | 4/1948 | Clark |
| 2,569,764 | A | | 10/1951 | Jonas |
| 2,586,045 | A | | 2/1952 | Hoza |
| 2,591,211 | A | | 4/1952 | Spencer |
| 2,608,078 | A | | 8/1952 | Anderson |
| 2,641,004 | A | | 6/1953 | Whiting et al. |
| 2,675,631 | A | | 4/1954 | Doughty |
| 2,994,322 | A | | 8/1961 | Cullen et al. |
| 3,583,081 | A | | 6/1971 | Hayashi |
| 3,694,940 | A | | 10/1972 | Stohr |
| 3,704,474 | A | | 12/1972 | Winkler |
| 3,766,566 | A | | 10/1973 | Tadokoro |
| 3,778,856 | A | | 12/1973 | Christie et al. |
| 3,952,427 | A | | 4/1976 | Von Den Benken et al. |
| 3,972,086 | A | | 8/1976 | Belli et al. |
| 4,027,402 | A | | 6/1977 | Liu et al. |
| 4,031,586 | A | | 6/1977 | Von Den Benken et al. |
| 4,211,806 | A | | 7/1980 | Civardi et al. |
| 4,232,458 | A | | 11/1980 | Bartels |
| 4,255,949 | A | | 3/1981 | Thorneburg |
| 4,258,480 | A | | 3/1981 | Famolare, Jr. |
| 4,317,292 | A | | 3/1982 | Melton |
| 4,373,361 | A | | 2/1983 | Thorneburg |
| 4,447,967 | A | | 5/1984 | Zaino |
| 4,465,448 | A | | 8/1984 | Aldridge |
| 4,607,439 | A | | 8/1986 | Harada |
| 4,737,396 | A | | 4/1988 | Kamat |
| 4,750,339 | A | | 6/1988 | Simpson, Jr. et al. |
| 4,756,098 | A | | 7/1988 | Boggia |
| 4,785,558 | A | | 11/1988 | Shiomura et al. |
| 4,813,158 | A | | 3/1989 | Brown |
| 4,967,494 | A | | 11/1990 | Johnson |
| 5,031,423 | A | | 7/1991 | Ikenaga |
| 5,095,720 | A | | 3/1992 | Tibbals, Jr. |
| 5,117,567 | A | | 6/1992 | Berger |
| 5,152,025 | A | | 10/1992 | Hirmas |
| 5,192,601 | A | | 3/1993 | Neisler |
| 5,345,638 | A | | 9/1994 | Nishida |
| 5,353,524 | A | | 10/1994 | Brier |
| 5,361,607 | A | * | 11/1994 | Mitsumoto ..... D04B 1/22 66/173 |
| 5,371,957 | A | | 12/1994 | Gaudio |
| 5,461,884 | A | | 10/1995 | McCartney et al. |
| 5,511,323 | A | | 4/1996 | Dahlgren |
| 5,572,860 | A | | 11/1996 | Mitsumoto et al. |
| 5,575,090 | A | | 11/1996 | Condini |
| 5,623,840 | A | | 4/1997 | Roell |
| 5,729,918 | A | | 3/1998 | Smets |
| 5,735,145 | A | | 4/1998 | Pernick |
| 5,746,013 | A | | 5/1998 | Fay, Sr. |
| 5,765,296 | A | | 6/1998 | Ludemann et al. |
| 5,884,419 | A | | 3/1999 | Davidowitz et al. |
| 5,970,629 | A | | 10/1999 | Tucker et al. |
| 5,996,189 | A | | 12/1999 | Wang |
| 6,029,376 | A | | 2/2000 | Cass |
| 6,032,387 | A | | 3/2000 | Johnson |
| 6,052,921 | A | | 4/2000 | Oreck |
| 6,088,936 | A | | 7/2000 | Bahl |
| 6,151,802 | A | | 11/2000 | Reynolds |
| 6,170,175 | B1 | | 1/2001 | Funk |
| 6,205,822 | B1 | | 3/2001 | Roell |
| 6,216,494 | B1 | | 4/2001 | Essig et al. |
| 6,227,010 | B1 | | 5/2001 | Roell |
| 6,299,962 | B1 | | 10/2001 | Davis et al. |
| 6,308,438 | B1 | | 10/2001 | Throneburg et al. |
| 6,333,105 | B1 | | 12/2001 | Tanaka et al. |
| 6,401,364 | B1 | | 6/2002 | Burt |
| 6,558,784 | B1 | | 5/2003 | Norton et al. |
| 6,588,237 | B2 | | 7/2003 | Cole et al. |
| 6,754,983 | B2 | | 6/2004 | Hatfield et al. |
| 6,910,288 | B2 | | 6/2005 | Dua |
| 6,922,917 | B2 | | 8/2005 | Kerns et al. |
| 6,931,762 | B1 | | 8/2005 | Dua |
| 6,983,626 | B2 | | 1/2006 | Okamoto |
| 6,986,269 | B2 | | 1/2006 | Dua |
| D517,297 | S | | 3/2006 | Jones et al. |
| 7,051,460 | B2 | | 5/2006 | Orei et al. |
| 7,056,402 | B2 | | 6/2006 | Koerwien et al. |
| 7,347,011 | B2 | | 3/2008 | Dua et al. |
| 7,424,783 | B2 | | 9/2008 | Meschter et al. |
| 7,441,348 | B1 | | 10/2008 | Dawson |
| 7,460,926 | B2 | | 12/2008 | Okamoto |
| 7,543,397 | B2 | | 6/2009 | Kilgore et al. |
| 7,568,298 | B2 | | 8/2009 | Kerns |
| 7,682,219 | B2 | | 3/2010 | Falla |
| 8,448,474 | B1 | | 5/2013 | Tatler et al. |
| 8,490,299 | B2 | | 7/2013 | Dua et al. |
| 8,621,891 | B2 | | 1/2014 | Dua et al. |
| 8,973,410 | B1 | | 3/2015 | Podhajny |
| 9,003,836 | B1 | | 4/2015 | Podhajny |
| 2002/0078599 | A1 | | 6/2002 | Delgorgue et al. |
| 2002/0148258 | A1 | | 10/2002 | Cole et al. |
| 2003/0126762 | A1 | | 7/2003 | Tseng |
| 2003/0191427 | A1 | | 10/2003 | Jay et al. |
| 2004/0118018 | A1 | | 6/2004 | Dua |
| 2004/0181972 | A1 | | 9/2004 | Csorba |
| 2005/0115284 | A1 | | 6/2005 | Dua |
| 2005/0193592 | A1 | | 9/2005 | Dua et al. |
| 2005/0273988 | A1 | | 12/2005 | Christy |
| 2005/0284000 | A1 | | 12/2005 | Kerns |
| 2006/0010931 | A1 | | 1/2006 | Lynch et al. |
| 2006/0059715 | A1 | | 3/2006 | Aveni |
| 2006/0162187 | A1 | | 7/2006 | Byrnes et al. |
| 2007/0022627 | A1 | | 2/2007 | Sokolowski et al. |
| 2007/0180730 | A1 | | 8/2007 | Greene et al. |
| 2007/0294920 | A1 | | 12/2007 | Baychar |
| 2008/0017294 | A1 | | 1/2008 | Bailey et al. |
| 2008/0078102 | A1 | | 4/2008 | Kilgore et al. |
| 2008/0110048 | A1 | | 5/2008 | Dua et al. |
| 2008/0189830 | A1 | | 8/2008 | Egglesfield |
| 2008/0313939 | A1 | | 12/2008 | Ardill |
| 2009/0068908 | A1 | | 3/2009 | Hinchcliff |

(56) References Cited

U.S. PATENT DOCUMENTS

| | | | |
|---|---|---|---|
| 2010/0051132 | A1 | 3/2010 | Glenn |
| 2010/0154256 | A1 | 6/2010 | Dua et al. |
| 2010/0170651 | A1 | 7/2010 | Scherb et al. |
| 2011/0030244 | A1 | 2/2011 | Motawi et al. |
| 2011/0078921 | A1 | 4/2011 | Greene et al. |
| 2012/0233882 | A1 | 9/2012 | Huffa et al. |
| 2012/0240429 | A1 | 9/2012 | Sokolowski et al. |
| 2012/0255201 | A1 | 10/2012 | Little |
| 2013/0160323 | A1 | 6/2013 | Hsiao |
| 2013/0239438 | A1 | 9/2013 | Dua et al. |
| 2013/0239625 | A1 | 9/2013 | Meir et al. |
| 2013/0269209 | A1 | 10/2013 | Lang et al. |
| 2013/0269212 | A1 | 10/2013 | Little |
| 2014/0137433 | A1 | 5/2014 | Craig |
| 2014/0150292 | A1 | 6/2014 | Podhajny et al. |
| 2015/0075031 | A1 | 3/2015 | Podhajny et al. |

FOREIGN PATENT DOCUMENTS

| | | | |
|---|---|---|---|
| DE | 870963 | C | 3/1953 |
| DE | 1084173 | B | 6/1960 |
| DE | 19738433 | A1 | 4/1998 |
| DE | 19728848 | A1 | 1/1999 |
| EP | 0279950 | A2 | 8/1988 |
| EP | 0448714 | A1 | 10/1991 |
| EP | 0728860 | A1 | 8/1996 |
| EP | 0758693 | A1 | 2/1997 |
| EP | 0898002 | A2 | 2/1999 |
| EP | 1233091 | A1 | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| EP | 2805638 | | 11/2014 |
| FR | 2171172 | A1 | 9/1973 |
| GB | 12787 | | 6/1904 |
| GB | 538865 | A | 8/1941 |
| GB | 2018837 | A | 10/1979 |
| GB | 1603487 | A | 11/1981 |
| JP | H06113905 | A | 4/1994 |
| JP | H08109553 | A | 4/1996 |
| JP | H11302943 | A | 11/1999 |
| NL | 7304678 | A | 10/1974 |
| TW | 1228158 | B | 2/2005 |
| TW | 201402030 | A | 1/2014 |
| TW | M498500 | U | 4/2015 |
| WO | 9003744 | A1 | 4/1990 |
| WO | 0032861 | A1 | 6/2000 |
| WO | 0231247 | A1 | 4/2002 |
| WO | WO 2013/108506 | A1 | 7/2013 |
| WO | WO 2013/126313 | A2 | 8/2013 |
| WO | WO 2014/050289 | A1 | 4/2014 |

OTHER PUBLICATIONS

Eberle, et al., Excerpt of Hannelore, Clothing Technology, 3rd edition, Third English ed, Beuth-Verlag GmnH, 2002, pp. 2-3, 83.
International Preliminary Report on Patentability for Application No. PCT/US2012/028534, dated Sep. 17, 2013.
International Preliminary Report on Patentability for Application No. PCT/US2012/028576, dated Sep. 17, 2013.
International Search Report and Written Opinion for Application No. PCT/US2009/056795, dated Apr. 20, 2010.
International Search Report and Written Opinion for Application No. PCT/US2012/028534, dated Oct. 17, 2012.
International Search Report and Written Opinion for Application No. PCT/US2012/028576, dated Oct. 1, 2012.
International Search Report and Written Opinion in connection with PCT/US2012/028559 dated Oct. 19, 2012.
Letter from Bruce Huffa dated Dec. 23, 2013 (71 Pages).
Spencer D.J., "A Comprehensive Handbook and Practical Guide," in: Knitting Technology, 3rd Edition, Woodhead Publishing Ltd., 2001, 413 pages.
International Preliminary Report on Patentability for International Application No. PCT/US2013/070651, dated Jun. 4, 2015.
International Preliminary Report on Patentability in connection with PCT/US2014/065134, dated Aug. 18, 2016.
International Search Report and Written Opinion for International Application No. PCT/US2013/070651, dated Mar. 27, 2014 (14 pages).
International Search Report and Written Opinion for International Application No. PCT/US2015/015340, dated Apr. 28, 2015 (10 pages).
International Search Report and Written Opinion for International Application No. PCT/US2015/015343, dated Jun. 16, 2015 (11 pages).
International Search Report and Written Opinion for International Application No. PCT/US2015/015346, dated Apr. 22, 2015 (10 pages).
International Search Report and Written Opinion for International Application No. PCT/US2016/026345, dated Oct. 4, 2016 (20 pages).
Office Action for Chinese Application No. 2013800364497, dated Sep. 25, 2015 (6 pages).
Office Action for European Application No. 13814673.3, dated Jun. 30, 2015 (2 pages).
Office Action for Korean Application No. 10-2014-7036252, dated Jan. 21, 2016 (11 pages).
Office Action for Taiwanese Application No. 102142337, dated May 27, 2015 (36 pages).
Office Action for Taiwanese Application No. 102142337, dated Sep. 21, 2015 (33 pages).
Office Action for Taiwanese Application No. 105111914, dated Dec. 26, 2016 (19 pages).

* cited by examiner

METHOD OF KNITTING A GUSSETED TONGUE FOR A KNITTED COMPONENT

CROSS-REFERENCE TO RELATED APPLICATIONS

This application is a continuation of U.S. patent application Ser. No. 14/273,641, filed on May 9, 2014, entitled "Method Of Knitting A Gusseted Tongue For A Knitted Component", which application is a continuation of U.S. patent application Ser. No. 14/170,822, filed on Feb. 3, 2014, entitled "Method Of Knitting A Gusseted Tongue For A Knitted Component", the disclosures of which applications are hereby incorporated by reference in their entirety.

BACKGROUND

The present invention relates generally to methods of manufacturing articles of footwear, and, in particular, to a knitting process for a knitted component with a gusseted tongue for incorporating into an upper of an article of footwear.

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

A variety of material elements (e.g., textiles, polymer foam, polymer sheets, leather, synthetic leather) are conventionally used in manufacturing the upper. In athletic footwear, for example, the upper may have multiple layers that each include a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements used in the upper, therefore, waste may be decreased while increasing the manufacturing efficiency and recyclability of the upper.

SUMMARY

Various configurations of an article of footwear may have an upper and a sole structure secured to the upper. A knitted component including a knit element and a gusseted tongue is incorporated into the upper of the article of footwear. The knit element defines a portion of an exterior surface of the upper and an opposite interior surface of the upper, with the interior surface defining a void for receiving a foot. The knit element and the gusseted tongue are formed together as a knitted component during the knitting process as a one-piece element. The gusseted tongue is formed of unitary knit construction with the knit element and is joined with the knit element in an instep area of the upper.

In one aspect, the invention provides a method of manufacturing a knitted component for an article of footwear, the knitted component defining an upper including an exterior surface and an opposite interior surface, the method comprising: knitting a first portion of the knitted component with a knitting machine, the first portion including at least a portion of one of a lateral side and a medial side of the upper; knitting a tongue portion of the knitted component with the knitting machine; transferring the first portion to a first set of needles associated with a first needle bed of the knitting machine; transferring the tongue portion to a second set of needles associated with a second needle bed of the knitting machine, the second needle bed being disposed opposite the first needle bed on the knitting machine; shifting at least one of the first needle bed and the second needle bed in a lateral direction relative to the other, thereby causing at least a portion of the first portion and a portion of the tongue portion to overlap; knitting at least one course of the knitted component with the knitting machine to join the overlapped first portion and tongue portion to form a combined portion; and knitting the remaining portion of the knitted component with the knitting machine.

In a further aspect, step of knitting the remaining portion of the knitted component further comprises the steps of: knitting a second portion of the knitted component with the knitting machine, the second portion including the opposite medial side or lateral side to the first portion; transferring the second portion to the first set of needles associated with the first needle bed of the knitting machine; transferring the combined portion to the second set of needles associated with the second needle bed of the knitting machine; shifting at least one of the first needle bed and the second needle bed in a lateral direction relative to the other, thereby causing at least a portion of the second portion and a portion of the combined portion to overlap; and knitting at least one course of the knitted component with the knitting machine to join the overlapped second portion and combined portion.

In another aspect, the invention provides a method of manufacturing a knitted component for an article of footwear, the method comprising: knitting a first portion of a knit element with a knitting machine; holding the first portion on needles of one of a first needle bed and an opposite second needle bed of the knitting machine; knitting a tongue portion with the knitting machine while the first portion of the knit element is held on the needles; shifting needles of the first needle bed on the knitting machine in a first lateral direction relative to the second needle bed; joining the first portion and the tongue portion to form a combined portion while the needles are shifted; holding the combined portion on the needles of one of the first needle bed and the second needle bed of the knitting machine; knitting a second portion of the knit element with the knitting machine while the combined portion is held on the needles; shifting needles of the first needle bed on the knitting machine in a second lateral direction relative to the second needle bed; and joining the second portion and the combined portion while the needles are shifted to form the knitted component.

In another aspect, the invention provides a knitted component for an article of footwear, the knitted component comprising: a knit element defining an upper of the article of footwear, the upper including a portion of an exterior surface of the knit element and an opposite interior surface of the knit element, the interior surface configured to define a void for receiving a foot; a gusseted tongue formed of unitary knit construction with the knit element and extending through a portion of an instep area of the upper; wherein at least a portion of the knit element overlaps a lateral side edge and a medial side edge of the gusseted tongue along opposite sides of the instep area, the lateral side edge and the medial side edge remaining unsecured to the knit element from a top end of the gusseted tongue to a forward portion of the instep area of the upper; wherein the gusseted tongue is joined to the knit element at the forward portion of the instep area across a width of the gusseted tongue; and wherein the lateral side edge and the medial side edge of the gusseted tongue are secured to the knit element along the forward portion of the instep area of the upper so as to form the knitted component as a one-piece element.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
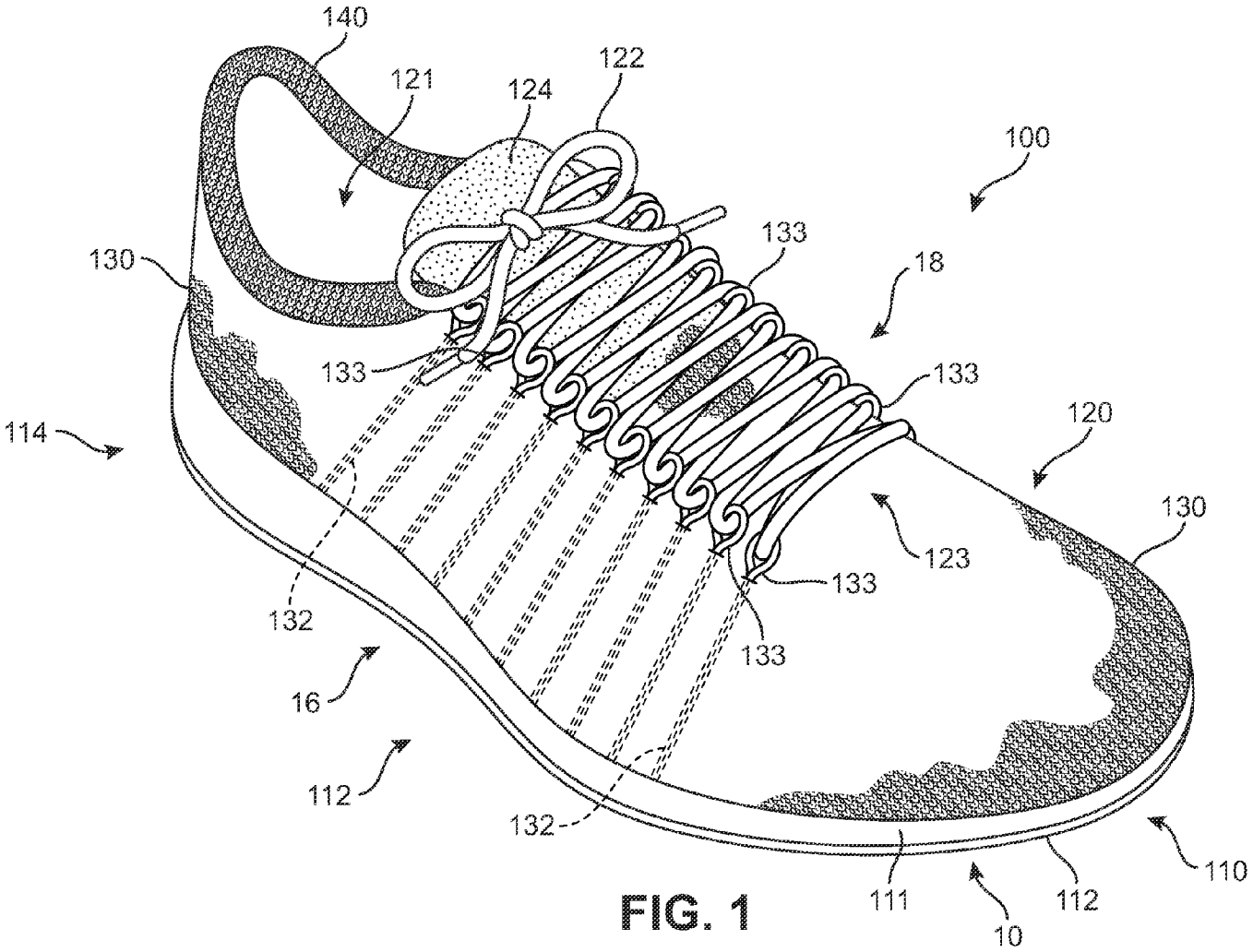
FIG. 1 is an isometric view of an exemplary embodiment of an article of footwear.

The following discussion and accompanying figures disclose a variety of concepts relating to knitted components and the manufacture of knitted components. Although the knitted components may be used in a variety of products, an article of footwear that incorporates one or more of the knitted components is disclosed below as an example. FIGS. 1 through 20 illustrate exemplary embodiments of an article of footwear incorporating a knitted component including a gusseted tongue formed of unitary knit construction with the remaining portions of the knitted component. The individual features of any of the knitted components described herein may be used in combination or may be provided separately in different configurations for articles of footwear. In addition, any of the features may be optional and may not be included in any one particular embodiment of a knitted component.

Footwear Configurations

FIGS. 1 through 4 illustrate an exemplary embodiment of an article of footwear 100, also referred to simply as article 100. In some embodiments, article of footwear 100 may include a sole structure 110 and an upper 120. Although article 100 is illustrated as having a general configuration suitable for running, concepts associated with article 100 may also be applied to a variety of other athletic footwear types, including baseball shoes, basketball shoes, cycling shoes, football shoes, tennis shoes, soccer shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to article 100 may be applied to a wide variety of footwear types.

Figure 2:
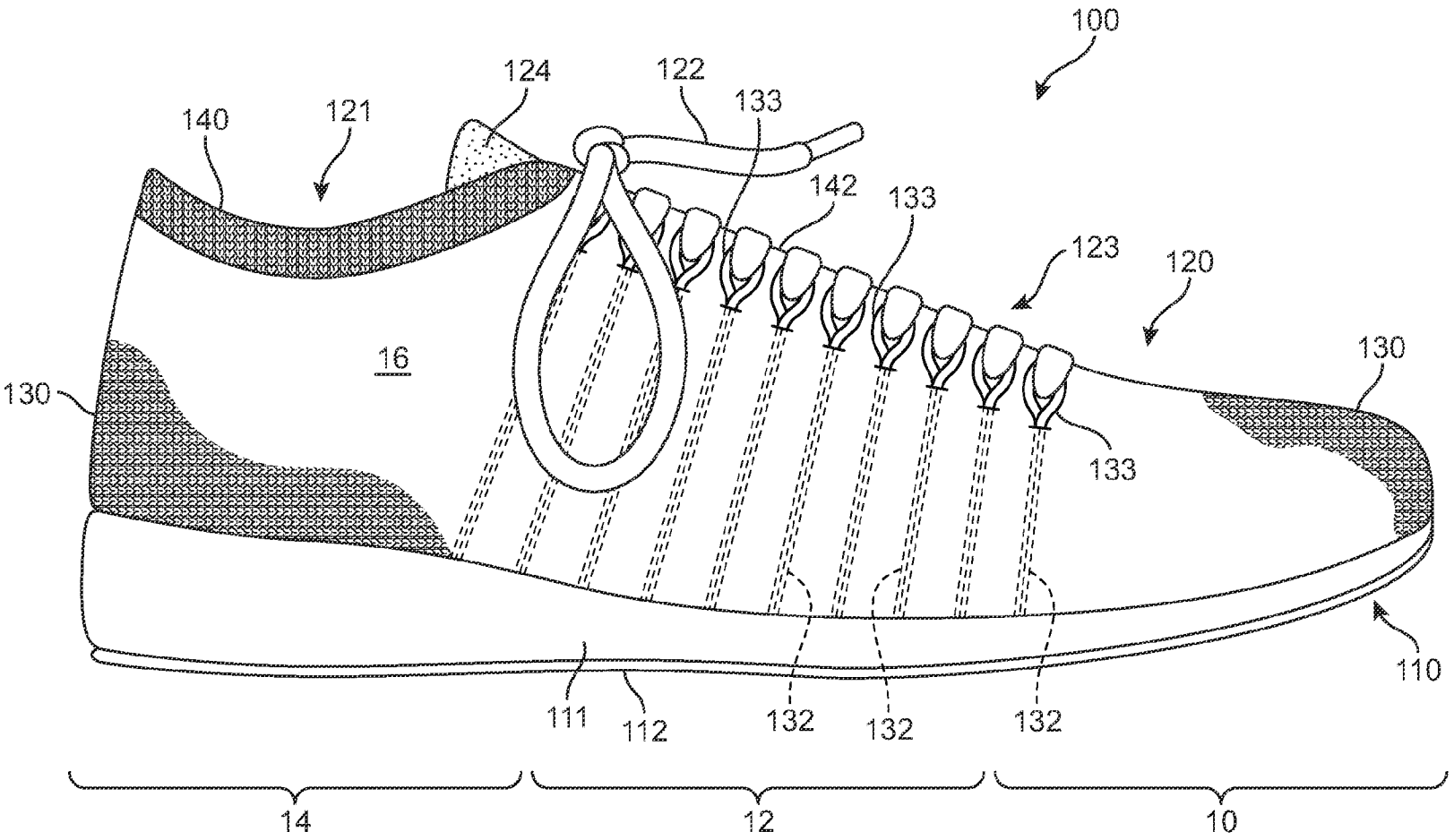
FIG. 2 is a lateral side view of an exemplary embodiment of an article of footwear.
Figure 3:
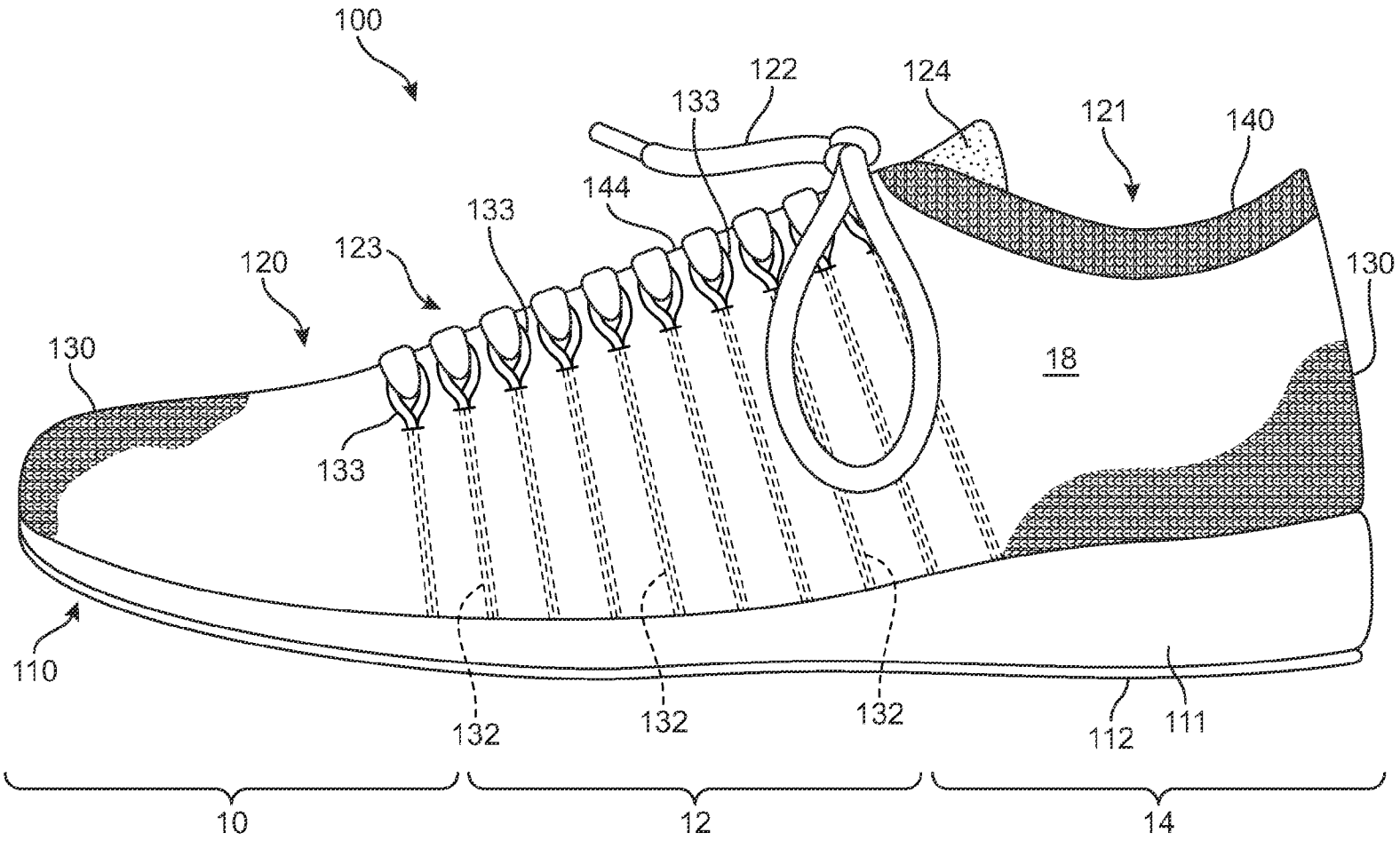
FIG. 3 is a medial side view of an exemplary embodiment of an article of footwear.

For reference purposes, article 100 may be divided into three general regions: a forefoot region 10, a midfoot region 12, and a heel region 14, as shown in FIGS. 1, 2, and 3. Forefoot region 10 generally includes portions of article 100 corresponding with the toes and the joints connecting the metatarsals with the phalanges. Midfoot region 12 generally includes portions of article 100 corresponding with an arch area of the foot. Heel region 14 generally corresponds with rear portions of the foot, including the calcaneus bone. Article 100 also includes a lateral side 16 and a medial side 18, which extend through each of forefoot region 10, midfoot region 12, and heel region 14 and correspond with opposite sides of article 100. More particularly, lateral side 16 corresponds with an outside area of the foot (i.e., the surface that faces away from the other foot), and medial side 18 corresponds with an inside area of the foot (i.e., the surface that faces toward the other foot). Forefoot region 10, midfoot region 12, and heel region 14 and lateral side 16, medial side 18 are not intended to demarcate precise areas of article 100. Rather, forefoot region 10, midfoot region 12, and heel region 14 and lateral side 16, medial side 18 are intended to represent general areas of article 100 to aid in the following discussion. In addition to article 100, forefoot region 10, midfoot region 12, and heel region 14 and lateral side 16, medial side 18 may also be applied to sole structure 110, upper 120, and individual elements thereof.

In an exemplary embodiment, sole structure 110 is secured to upper 120 and extends between the foot and the ground when article 100 is worn. In some embodiments, the primary elements of sole structure 110 are a midsole 111, an outsole 112, and a sockliner (not shown). Midsole 111 is secured to a lower surface of upper 120 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In other embodiments, midsole 111 may incorporate plates, moderators, fluid-filled chambers, lasting elements, or motion control members that further attenuate forces, enhance stability, or influence the motions of the foot, or midsole 111 may be primarily formed from a fluid-filled chamber. Outsole 112 is secured to a lower surface of midsole 111 and may be formed from a wear-resistant rubber material that is textured to impart traction. In embodiments of article 100 including a sockliner, the sockliner may be located within upper 120 and be positioned to extend under a lower surface of the foot to enhance the comfort of article 100. Although this configuration for sole structure 110 provides an example of a sole structure that may be used in connection with upper 120, a variety of other conventional or non-conventional configurations for sole structure 110 may also be used. Accordingly, in other embodiments, the features of sole structure 110 or any sole structure used with upper 120 may vary.

In some embodiments, upper 120 defines a void within article 100 for receiving and securing a foot relative to sole structure 110. The void is shaped to accommodate the foot and extends along a lateral side of the foot, along a medial side of the foot, over the foot, around the heel, and under the foot. Upper 120 includes an exterior surface and an opposite interior surface. Whereas the exterior surface faces outward and away from article 100, the interior surface faces inward and defines a majority or a relatively large portion of the void within article 100 for receiving the foot. Moreover, the interior surface may lay against the foot or a sock covering the foot. Upper 120 may also include a collar 140 that is located in at least heel region 14 and forms an ankle opening 121. Access to the void is provided by ankle opening 121. More particularly, the foot may be inserted into upper 120 through ankle opening 121 formed by collar 140, and the foot may be withdrawn from upper 120 through ankle opening 121 formed by collar 140.

In some embodiments, an instep area 123 extends forward from collar 140 and ankle opening 121 in heel region 14 over an area corresponding to an instep of the foot in midfoot region 12 to an area adjacent to forefoot region 10. In an exemplary embodiment, a gusseted tongue 124 is formed of unitary knit construction with upper 120 and extends through at least a portion of instep area 123 of upper 120 between lateral side 16 and medial side 18. In an exemplary embodiment, gusseted tongue 124 may be disconnected along lateral and medial sides through a portion of instep area 123 such that gusseted tongue 124 is moveable within an opening between a lateral inner edge 142 disposed on a lateral portion and a medial inner edge 144 disposed on a medial portion on opposite sides of instep area 123. In one embodiment, the remaining portion of instep area 123 from the end of gusseted tongue 124 and continuing in a forward direction towards forefoot region 10, may be integrally attached to and formed of unitary knit construction with portions of upper 120 along lateral and medial sides through instep area 123. Accordingly, as shown in the Figures, upper 120 may extend substantially continuously across instep area 123 between lateral side 16 and medial side 18.

A lace 122 extends through various lace apertures 133 and permits the wearer to modify dimensions of upper 120 to accommodate proportions of the foot. In some embodiments, lace apertures 133 may be lace-receiving members formed by a looped portion of an inlaid strand 132, as will be further described below. More particularly, lace 122 permits the wearer to tighten upper 120 around the foot, and lace 122 permits the wearer to loosen upper 120 to facilitate entry and removal of the foot from the void (i.e., through ankle opening 140). In an exemplary embodiment, lace apertures are disposed along sides of instep area 123 on each of lateral side 16 and medial side 18. With this configuration, lace 122 extending through lace apertures 133 may be tightened by pulling and drawing each side of instep area 123 nearer to each other. In addition, gusseted tongue 124 of upper 120 extends under a portion of lace 122 to enhance the comfort of article 100. In further configurations, upper 120 may include additional elements, such as (a) a heel counter in heel region 14 that enhances stability, (b) a toe guard in forefoot region 10 that is formed of a wear-resistant material, and (c) logos, trademarks, and placards with care instructions and material information.

Figure 4:
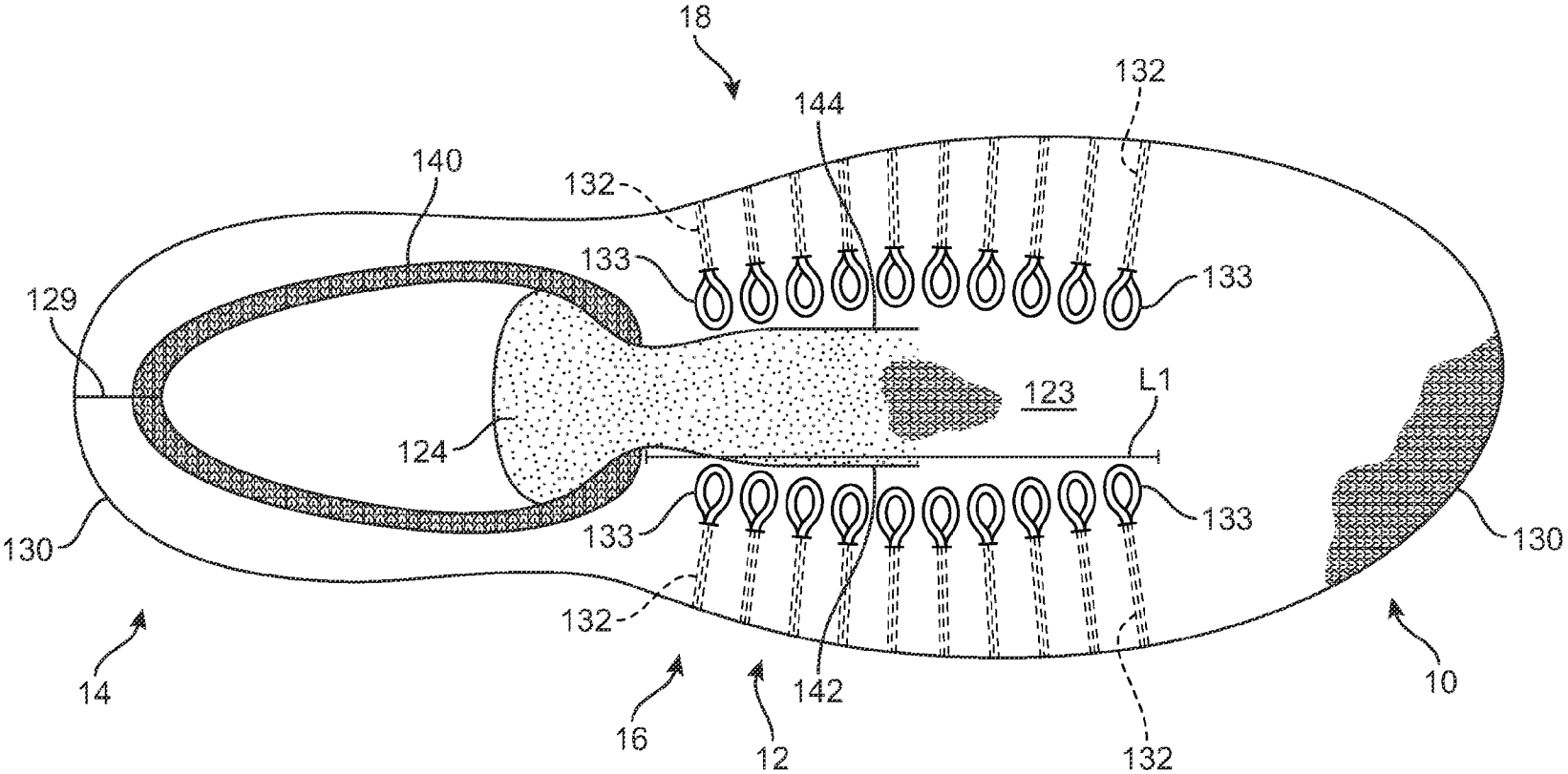
FIG. 4 is a top view of an exemplary embodiment of an article of footwear.

Many conventional footwear uppers are formed from multiple material elements (e.g., textiles, polymer foam, polymer sheets, leather, synthetic leather) that are joined through stitching or bonding, for example. In contrast, a majority of upper 120 is formed from a knitted component 130, which extends through each of forefoot region 10, midfoot region 12, and heel region 14, along both lateral side 16 and medial side 18, over forefoot region 10, and around heel region 14. In addition, knitted component 130 forms portions of both an exterior surface and an opposite interior surface of upper 120. As such, knitted component 130 defines at least a portion of the void within upper 120. In some configurations, knitted component 130 may also extend under the foot. In other embodiments, however, a strobel sock or thin sole-shaped piece of material is secured to knitted component 130 to form a base portion of upper 120 that extends under the foot for attachment with sole structure 110. In embodiments including a strobel sock, the strobel sock may be attached to upper 120 along edges of knitted component 130 and secured to an upper surface of midsole 111, thereby forming a portion of upper 120 that encloses the interior void and extends under a sockliner, if present. In addition, a seam 129 extends vertically through heel region 14, as depicted in FIG. 4, to join edges of knitted component 130.

In some embodiments, knitted component 130 may include upper 120 and gusseted tongue 124 formed of unitary knit construction. Knitted components that include upper 120 and gusseted tongue 124 may be formed with a relatively smaller number of material elements. As discussed in the Background section above, decreasing the number of material elements used in forming an upper may decrease waste, while also increasing the manufacturing efficiency and recyclability of the upper. The tongue and other portions, such as the collar, of conventional uppers are often formed from multiple separate material elements that are later joined together. As discussed in greater detail below, however, a gusseted tongue may be primarily formed through knitting processes (rather than stitch and turn methods) that decrease waste and increase manufacturing efficiency and recyclability. Additionally, the structure of gusseted tongue 124 may incorporate smaller numbers of seams or other discontinuities, thereby enhancing the overall comfort of article 100.

Additional advantages of constructing gusseted tongue 124 during the knitting process and of unitary knit construction with upper 120 include providing more efficient manufacture and common properties. More particularly, manufacturing efficiency may be increased by forming more of knitted component 130 during the knitting process and eliminating various steps (e.g., making a separate tongue, securing the tongue) that are often performed manually. Gusseted tongue 124 and upper 120 may also have common properties when formed from the same yarn (or type of yarn) or with similar knit structures. For example, using the same yarn in both of gusseted tongue 124 and upper 120 imparts similar durability, strength, stretch, wear-resistance, biodegradability, thermal, and hydrophobic properties. In addition to physical properties, using the same yarn in both of gusseted tongue 124 and upper 120 may impart common aesthetic or tactile properties, such as color, sheen, and texture. Using the same knit structures in both of gusseted tongue 124 and upper 120 may also impart common physical properties and aesthetic properties. These advantages may also be present when at least a portion of gusseted tongue 124 and at least a portion of upper 120 are formed from a common yarn (or type of yarn) or with common knit structures.

Knitted Component Configurations

Figure 5:
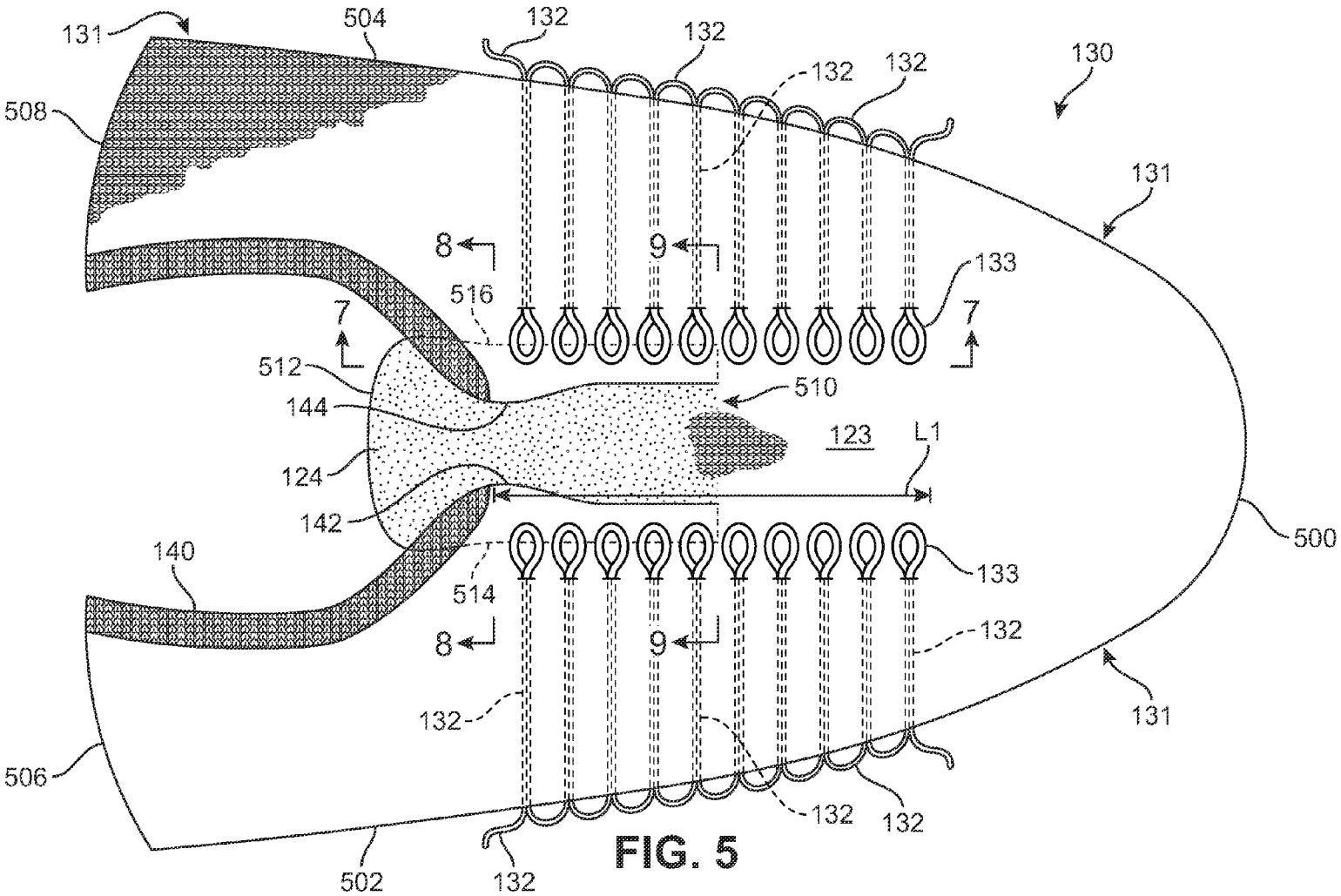
FIG. 5 is a top plan view of an exemplary embodiment of a knitted component including a gusseted tongue.

Referring now to FIG. 5, knitted component 130 is depicted separate from a remainder of article 100 in a planar or flat configuration. Although seams may be present in knitted component 130 when incorporated into upper 120, a majority of knitted component 130 has a substantially seamless configuration. Moreover, knitted component 130 may be formed of unitary knit construction. As utilized herein, a knitted component (e.g., knitted component 130) is defined as being formed of "unitary knit construction" when formed as a one-piece element through a knitting process. That is, the knitting process substantially forms the various features and structures of knitted component 130 without the need for significant additional manufacturing steps or processes. A unitary knit construction may be used to form a knitted component having structures or elements that include one or more courses of yarn, strands, or other knit material that are joined such that the structures or elements include at least one course in common (i.e., sharing a common yarn) and/or include courses that are substantially continuous between each of the structures or elements. With this arrangement, a one-piece element of unitary knit construction is provided.

Although portions of knitted component 130 may be joined to each other (e.g., edges of knitted component 130 being joined together) following the knitting process, knitted component 130 remains formed of unitary knit construction because it is formed as a one-piece knit element. Moreover, knitted component 130 remains formed of unitary knit construction when other elements (e.g., a lace, logos, trademarks, placards with care instructions and material information, structural elements) are added following the knitting process.

The primary elements of knitted component 130 are a knit element 131 and an inlaid strand 132. Knit element 131 is formed from at least one yarn that is manipulated (e.g., with a knitting machine) to form a plurality of intermeshed loops that define a variety of courses and wales. That is, knit element 131 has the structure of a knit textile. Inlaid strand 132 extends through knit element 131 and passes between the various loops within knit element 131. Although inlaid strand 132 generally extends along courses within knit element 131, inlaid strand 132 may also extend along wales within knit element 131. Advantages of inlaid strand 132 include providing support, stability, and structure. For example, inlaid strand 132 assists with securing upper 120 around the foot, limits deformation in areas of upper 120 (e.g., imparts stretch-resistance) and operates in connection with lace 122 to enhance the fit of article 100.

As shown in FIG. 5, knit element 131 has a generally U-shaped configuration that is outlined by an outer perimeter that extends around knitted component 130 from lateral side 16 to medial side 18. In an exemplary embodiment, the outer perimeter may be defined by a front perimeter edge 500, a lateral side perimeter edge 502, a medial side perimeter edge 504, and a pair of heel edges, including a lateral heel edge 506 and a medial heel edge 508. When incorporated into article 100, front perimeter edge 500, lateral side perimeter edge 502, and medial side perimeter edge 504 lay against the upper surface of midsole 111 and may be joined to a strobel sock to enclose the interior void of upper 120. In addition, the pair of heel edges, lateral heel edge 506 and medial heel edge 508, are joined to each other at seam 129 and extend vertically upwards along upper 120 in heel region 14. In some configurations of article 100, a material element may cover seam 129 between lateral heel edge 506 and medial heel edge 508 to reinforce seam 129 and enhance the aesthetic appeal of article 100.

In some embodiments, knit element 131 may further include an inner perimeter. In an exemplary embodiment, the inner perimeter may be defined by an inner perimeter edge along collar 140 that extends around ankle opening 121. In an exemplary embodiment, the inner perimeter may further extend forward towards instep area 123, where lace 122, lace apertures 133, and gusseted tongue 124 are located. In one embodiment, the inner perimeter may extend along lateral inner edge 142 and medial inner edge 144 through at least a portion of instep area 123, as will be further described below.

Inlaid strand 132, as noted above, extends through knit element 131 and passes between the various loops within knit element 131. More particularly, inlaid strand 132 is located within the knit structure of knit element 131, which may have the configuration of a single textile layer in the area of inlaid strand 132, and between opposite surfaces. When knitted component 130 is incorporated into upper 120 for article 100, therefore, inlaid strand 132 is located between the exterior surface and the interior surface of upper 120. In some configurations, portions of inlaid strand 132 may be visible or exposed on one or both of the exterior or interior surfaces. For example, inlaid strand 132 may lay against one of the surfaces, or knit element 131 may form indentations or apertures through which inlaid strand 132 passes. An advantage of having inlaid strand 132 located between the surfaces of the knitted component 130 is that knit element 131 may protect inlaid strand 132 from abrasion and snagging.

In some embodiments, inlaid strand 132 may extend upwards through knit element 131 in a vertical direction from sole structure 110 towards instep area 123. As shown in FIG. 5, inlaid strand 132 repeatedly extends from lateral side perimeter edge 502 towards lateral inner edge 142 on lateral side 16 and from medial side perimeter edge 504 towards medial inner edge 144 on medial side 18 and back to towards the respective lateral side perimeter edge 502 and medial side perimeter edge 504. When knitted component 130 is incorporated into article 100, knit element 131 extends from instep area 123 of upper 120 (i.e., where lace 122, lace apertures 133, and gusseted tongue 124 are located) to a lower area of upper 120 (i.e., where knitted component 130 joins with sole structure 110). In this configuration, inlaid strand 132 also extends from instep area 123 to the lower area. More particularly, inlaid strand repeatedly passes through knit element 131 from instep area 123 to the lower area. In an exemplary embodiment, portions of inlaid strand 132 may form a loop that serves as lace aperture 133 and then may extend downwards back in the vertical direction from instep area 123 towards sole structure 110. In addition, when article 100 is provided with lace 122, inlaid strand 132 may be tensioned when lace 122 is tightened, and inlaid strand 132 resists stretch in upper 120. Moreover, inlaid strand 132 assists with securing upper 120 around the foot and operates in connection with lace 122 to enhance the fit of article 100.

Although knit element 131 may be formed in a variety of ways, courses of the knit structure generally extend in the same direction as inlaid strand 132. That is, courses may extend in the direction extending between instep area 123 and the lower area. As such, a majority of inlaid strand 132 extends along the courses within knit element 131.

As discussed above, inlaid strand 132 passes back and forth through knit element 131. Referring to FIG. 5 inlaid strand 132 also repeatedly exits knit element 131 at lateral side perimeter edge 502 and medial side perimeter edge 504 and then re-enters knit element 131 at another location along lateral side perimeter edge 502 or medial side perimeter edge 504, thereby forming loops along the outer perimeter of knitted component 130. With this configuration, each section of inlaid strand 132 that extends between instep area 123 and the lower area may be independently tensioned, loosened, or otherwise adjusted during the manufacturing process of article 100. That is, prior to securing sole structure 110 to upper 120, sections of inlaid strand 132 may be independently adjusted to the proper tension.

In some embodiments, a separate inlaid strand may be provided for each of the portions of knitted component 130 associated with lateral side 16 and medial side 18. That is, a first inlaid strand may be provided on lateral side 16 and a second inlaid strand may be provided on medial side 18 such that the inlaid strands are independent from one another. For example, in an exemplary embodiment, inlaid strand 132 associated with the respective lateral side 16 and medial side 18 of knitted component 130 may be formed during the knitting process with separate yarns, including yarns of similar or different material constructions. In other embodiments, a single inlaid strand may be used with knitted component 130 and may extend through both lateral side 16 and medial side 18.

In comparison with knit element 131, inlaid strand 132 may exhibit greater stretch-resistance. That is, inlaid strand 132 may stretch less than knit element 131. Given that numerous sections of inlaid strand 132 extend from instep area 123 of upper 120 to the lower area of upper 120, inlaid strand 132 imparts stretch-resistance to the portion of upper 120 between instep area 123 and the lower area. Moreover, placing tension upon lace 122 may impart tension to inlaid strand 132, thereby inducing the portion of upper 120 between instep area 123 and the lower area to lay against the foot. As such, inlaid strand 132 operates in connection with lace 122 to enhance the fit of article 100.

Knit element 131 may incorporate various types of yarn that impart different properties to separate areas of upper 120. That is, one area of knit element 131 may be formed from a first type of yarn that imparts a first set of properties, and another area of knit element 131 may be formed from a second type of yarn that imparts a second set of properties. In this configuration, properties may vary throughout upper 120 by selecting specific yarns for different areas of knit element 131. The properties that a particular type of yarn will impart to an area of knit element 131 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the yarns selected for knit element 131 may affect the properties of upper 120. For example, a yarn forming knit element 131 may be a monofilament yarn or a multifilament yarn. The yarn may also include separate filaments that are each formed of different materials. In addition, the yarn may include filaments that are each formed of two or more different materials, such as a bicomponent yarn with filaments having a sheath-core configuration or two halves formed of different materials. Different degrees of twist and crimping, as well as different deniers, may also affect the properties of upper 120. Accordingly, both the materials forming the yarn and other aspects of the yarn may be selected to impart a variety of properties to separate areas of upper 120.

As with the yarns forming knit element 131, the configuration of inlaid strand 132 may also vary significantly. In addition to yarn, inlaid strand 132 may have the configurations of a filament (e.g., a monofilament), thread, rope, webbing, cable, or chain, for example. In comparison with the yarns forming knit element 131, the thickness of inlaid strand 132 may be greater. In some configurations, inlaid strand 132 may have a significantly greater thickness than the yarns of knit element 131. Although the cross-sectional shape of inlaid strand 132 may be round, triangular, square, rectangular, elliptical, or irregular shapes may also be utilized. Moreover, the materials forming inlaid strand 132 may include any of the materials for the yarn within knit element 131, such as cotton, elastane, polyester, rayon, wool, and nylon. As noted above, inlaid strand 132 may exhibit greater stretch-resistance than knit element 131. As such, suitable materials for inlaid strand 132 may include a variety of engineering filaments that are utilized for high tensile strength applications, including glass, aramids (e.g., para-aramid and meta-aramid), ultra-high molecular weight polyethylene, and liquid crystal polymer. As another example, a braided polyester thread may also be utilized as inlaid strand 132.

An inlaid strand in the form of a tensile element or other suitable element, as well as the method of manufacturing a knitted component incorporating an inlaid strand and knit structures, for use in the embodiments described herein is disclosed in one or more of commonly-owned U.S. patent application Ser. No. 12/338,726 to Dua et al., entitled "Article of Footwear Having An Upper Incorporating A Knitted Component", filed on Dec. 18, 2008 and issued as U.S. Pat. No. 8,490,299 on Jul. 23, 2013, U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012, and U.S. patent application Ser. No. 13/400,511, entitled "Article Of Footwear Incorporating A Knitted Component With A Tongue", filed on Feb. 20, 2012 and issued as U.S. Pat. No. 8,448,474 on May 28, 2013, the disclosures of which applications are hereby incorporated by reference in their entirety (collectively referred to herein as the "Inlaid Strand cases").

In some embodiments, knitted component 130 may include gusseted tongue 124. Gusseted tongue 124 is located within instep area 123 (i.e., where lace 122 and lace apertures 133 are located) of knitted component 130 and extends along at least a portion of a length of instep area 123. When incorporated into article 100, for example, gusseted tongue 124 extends from a forward portion 510 of instep area 123 to ankle opening 121. In an exemplary embodiment, gusseted tongue 124 is formed of unitary knit construction with knit element 131 forming the majority of upper 120 of knitted component 130 at forward portion 510 of instep area 123. That is, gusseted tongue 124 is joined through knitting to knit element 131 at forward portion 510 of instep area 123 such that gusseted tongue 124 and knit element 131 include at least one course in common and/or include courses that are substantially continuous between gusseted tongue 124 and knit element 131 at forward portion 510 of instep area 123 of upper 120.

In an exemplary embodiment, knitted component 130 includes gusseted tongue 124 that is formed of unitary knit construction with knit element 131 at forward portion 510. As described previously, at forward portion 510, knit element 131 and gusseted tongue 124 are joined through knitting such that gusseted tongue 124 and knit element 131 forming the majority of upper 120 form a one-piece element. In one embodiment, gusseted tongue 124 extends at least partially through instep area 123 from forward portion 510 rearwards to a top end 512 adjacent to collar 140 at ankle opening 121. Additionally, gusseted tongue 124 further includes opposite sides that extend along a portion of the length of instep area 123 and that are unsecured to knit element 131. In an exemplary embodiment, gusseted tongue 124 includes a lateral side edge 514 extending through a portion of the length of instep area 123 on lateral side 16 and a medial side edge 516 extending through a portion of the length of instep area 123 on medial side 18. In this embodiment, forward portion 510 of gusseted tongue 124 is secured to knit element 131, while each of lateral side edge 514 and medial side edge 516 remain unsecured to knit element 131. With this configuration, gusseted tongue 124 may be configured to move between lateral inner edge 142 and medial inner edge 144 on opposite sides of instep area 123.

Figure 6:
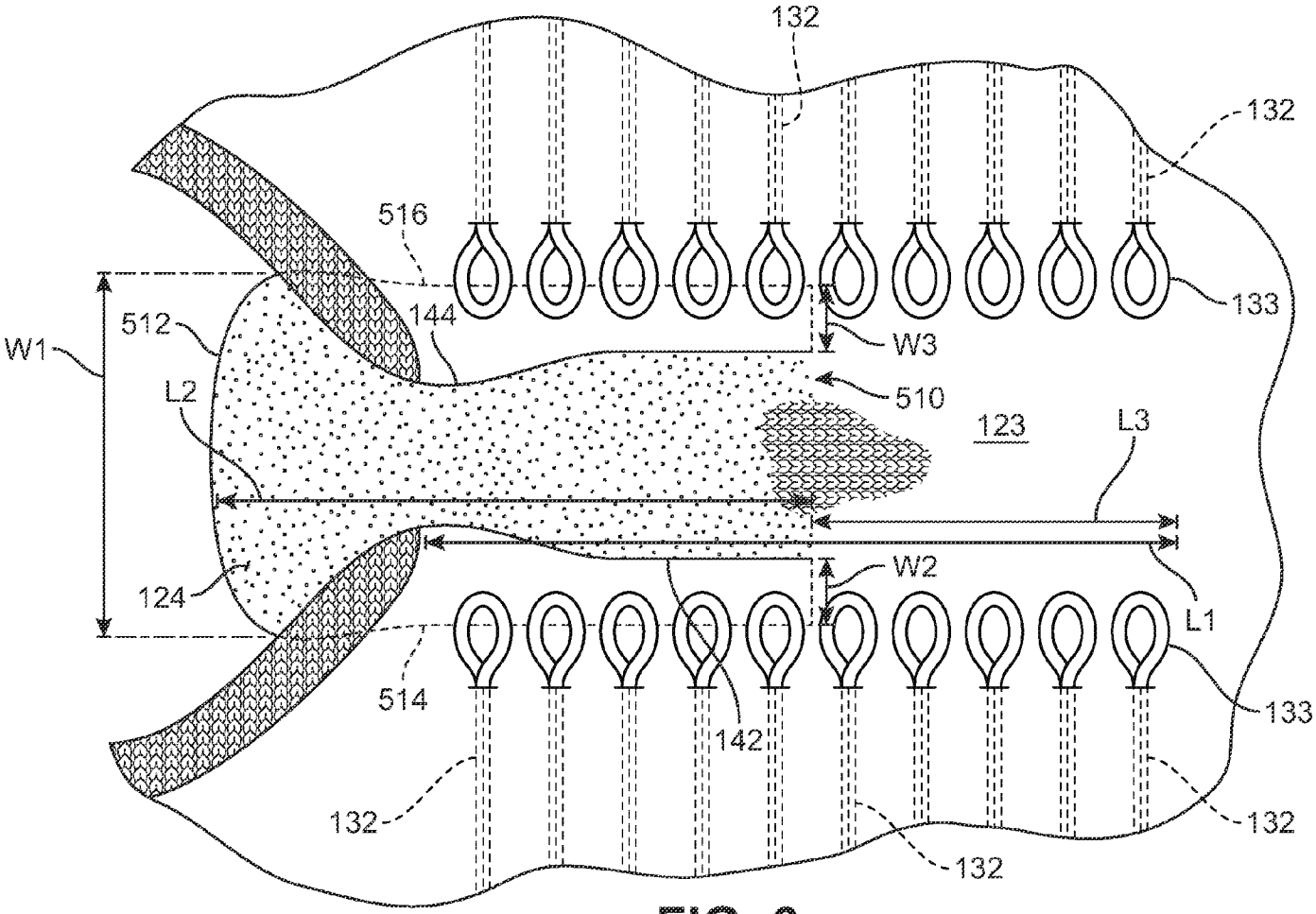
FIG. 6 is an enlarged view of an exemplary embodiment of a gusseted tongue.

In some embodiments, gusseted tongue 124 may be configured to extend through varying portions of the length of instep area 123. As shown in FIGS. 5 and 6, in an exemplary embodiment, gusseted tongue 124 may extend only partially through the length of instep area 123, and the remaining portion of instep area 123 may be formed by a substantially continuous portion of knit element 131 that extends across instep area 123 between lateral side 16 and medial side 18.

In one embodiment, instep area 123 may extend approximately a first length L1 along a longitudinal direction of knitted component 130. Gusseted tongue 124 may have a second length L2 from top end 512 to forward portion 510, with second length L2 being less than first length L1. In addition, forward portion 510 may be located approximately a third length L3 from the end of instep area 123, with third length L3 being less than first length L1. In some cases, third length L3 may be configured so that forward portion 510 is located approximately at a midpoint of first length L1 of instep area 123. In addition, in some embodiments, second length L2 and third length L3 may be approximately equal.

Referring now to FIG. 6, an enlarged view of instep area 123 of upper 120 is illustrated. In an exemplary embodiment, gusseted tongue 124 may have a first width W1 between opposite side edges, lateral side edge 514 and medial side edge 516, across the lateral direction of knitted component 130. In this embodiment first width W1 is wider than, and extends beyond, the gap extending between lateral inner edge 142 and medial inner edge 144 of instep area 123 adjacent ankle opening 121. In one embodiment, gusseted tongue 124 and portions of knit element 131 may have an overlapping configuration.

As shown in FIG. 6, at least portions of gusseted tongue 124 adjacent to lateral side edge 514 and medial side edge 516 and portions of knit element 131 adjacent to lateral inner edge 142 and medial inner edge 144 may have an overlapping configuration. In an exemplary embodiment, portions of knit element 131 extending outwards in the lateral direction from each of lateral inner edge 142 and medial inner edge 144 may lay above and overlap portions of gusseted tongue 124. Similarly, portions of gusseted tongue 124 extending inwards in the lateral direction from each of lateral side edge 514 and medial side edge 516 may lay below and be overlapped by these portions of knit element 131.

In different embodiments, the extent of the overlapping portions of gusseted tongue 124 and knit element 131 may vary. In one embodiment, the portion of gusseted tongue 124 adjacent to lateral side edge 514 that is overlapped by knit element 131 may be associated with a second width W2. Similarly, the portion of gusseted tongue 124 adjacent to medial side edge 516 that is overlapped by knit element 131 may be associated with a third width W3. Both of second width W2 and third width W3 are less than first width W1, which is the overall total width of gusseted tongue 124. In some cases, second width W2 and third width W3 may equal. In other cases, however second width W2 and third width W3 may vary so that second width W2 is larger or smaller than third width W3 to provide an offset configuration to the overlapping portions of gusseted tongue 124.

Figure 7:
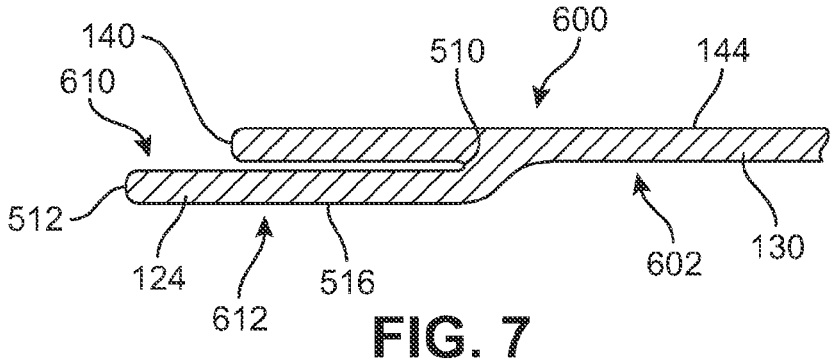
FIG. 7 is a cross-sectional view of the exemplary embodiment of a knitted component including a gusseted tongue taken along the line shown in FIG. 5.
Figure 8:
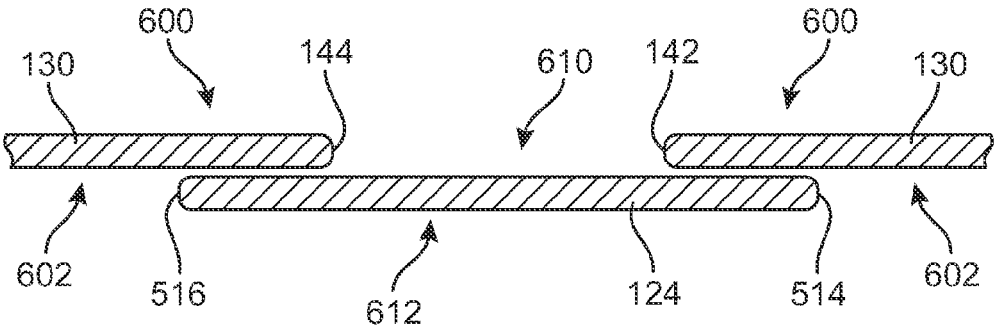
FIG. 8 is a cross-sectional view of the exemplary embodiment of a knitted component including a gusseted tongue taken along the line shown in FIG. 5.
Figure 9:
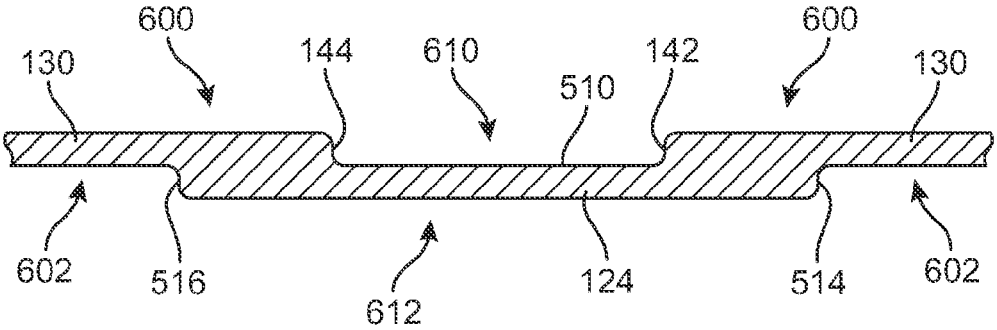
FIG. 9 is a cross-sectional view of the exemplary embodiment of a knitted component including a gusseted tongue taken along the line shown in FIG. 5.

FIGS. 7-9 illustrate various cross-sectional views of portions of knitted component 130 including gusseted tongue 124 taken along the lines indicated in FIG. 5. Referring now to FIG. 7, a cross-sectional view of knitted component 130 taken along a longitudinal direction is illustrated. In this embodiment, the overlapping configuration of unsecured portions of gusseted tongue 124 and knit element 131 may be seen near ankle opening 121. In an exemplary embodiment, gusseted tongue 124 is unsecured to knit element 131 from top end 512 and extending to forward portion 510. At forward portion 510, gusseted tongue 124 and knit element 131 are formed of unitary knit construction by being joined through knitting so as to be a one-piece element. As described above, with this overlapping configuration, knit element 131 lays above portions of gusseted tongue 124.

For example, as shown in FIG. 7, knit element 131 may include an exterior surface 600 associated with the exterior of upper 120 and an opposite interior surface 602 associated with the interior of upper 120. Additionally, gusseted tongue 124 may include an outer surface 610 oriented in an outwards direction and facing away from the interior of upper 120 and an opposite inner surface 612 facing towards the interior of upper 120. In this embodiment, where a portion of knit element 131 overlaps a portion of gusseted tongue 124, interior surface 602 of knit element 131 faces towards outer surface 610 of gusseted tongue 124.

Referring now to FIG. 8, a cross-sectional view of knitted component 130 taken along a lateral direction at a portion of knitted component 130 where knit element 131 and gusseted tongue 124 are unsecured is illustrated. In an exemplary embodiment, portions of knit element 131 overlap and extend over portions of gusseted tongue 124 along each of lateral side 16 and medial side 18 of knitted component 130, while a central portion of gusseted tongue 124 is not overlapped by any portion of knit element 131. As shown in FIG. 8, lateral inner edge 142 of knit element 131 overlaps lateral side edge 514 of gusseted tongue 124 and medial inner edge 144 of knit element 131 overlaps medial side edge 516 so that interior surface 602 of knit element 131 faces towards outer surface 610 of gusseted tongue 124. In this embodiment, knit element 131 and gusseted tongue 124 remain unsecured to each other so that while outer surface 610 and interior surface 602 may be in contact, they remain free to move away from each other so as to no longer be in contact.

Referring now to FIG. 9, a cross-sectional view of knitted component 130 taken along a lateral direction at a portion of knitted component 130 where knit element 131 and gusseted tongue 124 are secured along forward portion 510 is illustrated. In this embodiment, gusseted tongue 124 and knit element 131 are formed of unitary knit construction by being joined through knitting so as to be a one-piece element. Therefore, in contrast with FIG. 8 where gusseted tongue 124 and knit element are unsecured, in FIG. 9, gusseted tongue 124 and knit element 131 are integrally secured and joined with each other at forward portion 510. In an exemplary embodiment, exterior surface 600 of knit element 131 and outer surface 610 of gusseted tongue 124 may be substantially continuous on the exterior of upper 120 at forward portion 510. Similarly, interior surface 602 of knit element 131 and inner surface 612 of gusseted tongue 124 may also be substantially continuous on the interior of upper 120 at forward portion 510.

Additionally, in embodiments where each component of knitted component 130, including knit element 131 and gusseted tongue 124, have a double layer configuration (i.e., formed by two knitted layers), forward portion 510 may transition from two co-extensive and overlapping double knitted layers, for a total of four knitted layers, to a single double knitted layer once gusseted tongue 124 and knit element 131 have been joined at forward portion 510 to form the one-piece element.

In the exemplary embodiments described herein, gusseted tongue 124 may serve to provide additional expansion capabilities to portions of upper 120. With this configuration, gusseted tongue 124 may assist with inserting a foot within the void formed by upper 120. For example, in embodiments where knit element 131 may include a relatively inelastic or inextensible yarn, gusseted tongue 124 may permit ankle opening 121 to have a larger opening corresponding to the location of forward portion 510 to facilitate entry of a foot of a wearer through ankle opening 121.

Tongue Knitting Process

FIGS. 10 through 20 illustrate various knitting processes that may be used to manufacture a knitted component in accordance with the principles described herein. In various embodiments described herein, the different knit structures of a particular knitted component may be made using various types of knit structures, including knit types and yarn types.

Figure 10:
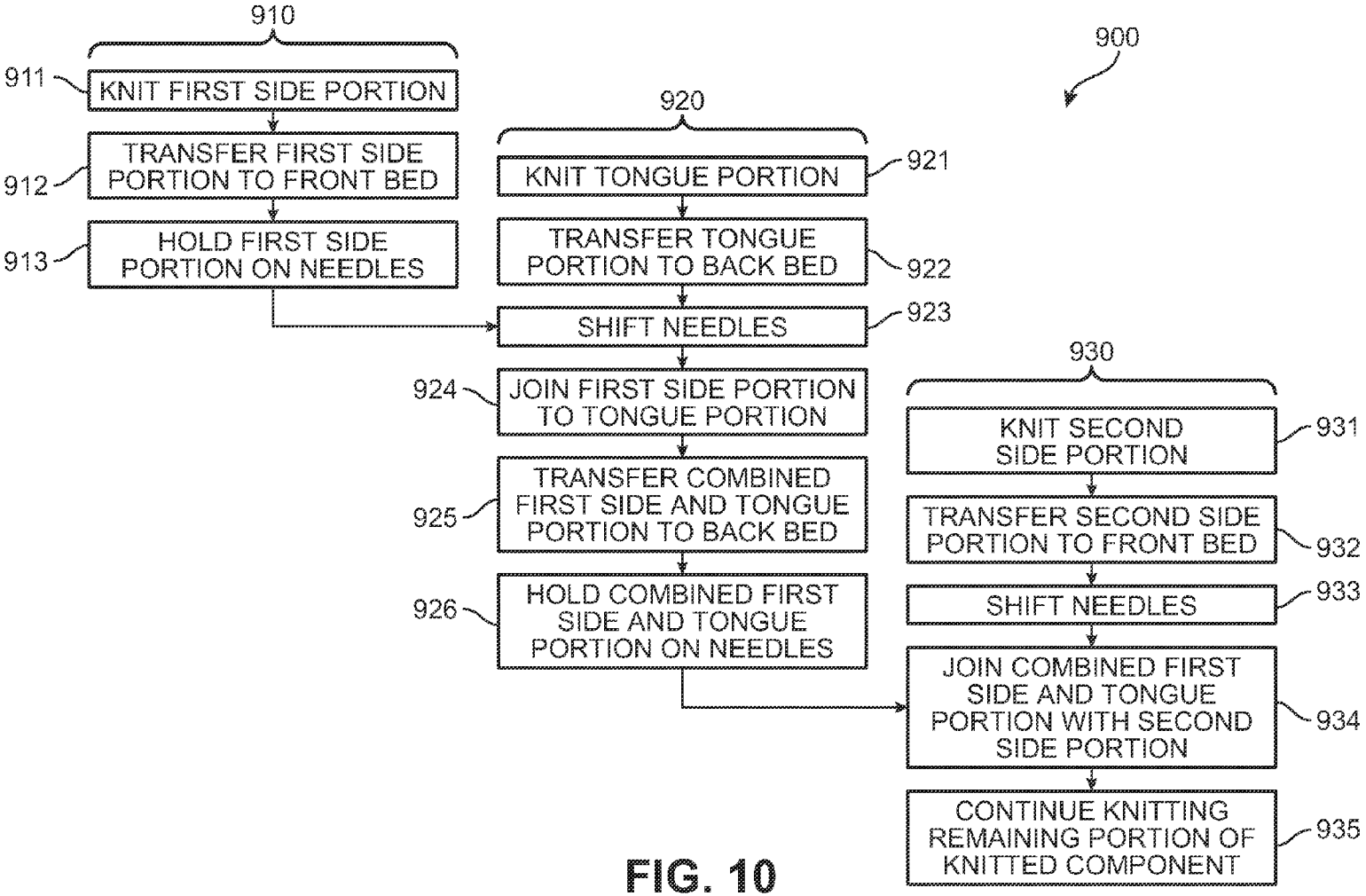
FIG. 10 is a flowchart of an exemplary process for knitting a knitted component including a gusseted tongue.

FIG. 10 illustrates a flowchart of an exemplary knitting process 900 for knitting a knitted component having a gusseted tongue, including knitted component 130 having gusseted tongue 124. It should be understood that the steps of knitting process 900 are merely exemplary and may include additional steps that are not illustrated. For example, in some embodiments, a knitted component may include additional elements or components, such as inlaid strands or knit structures, that are formed using knitting processes in addition to those steps illustrated in FIG. 10. In an exemplary embodiment, one or more steps of knitting process 900 may be performed and/or controlled using a control unit including a processor or computer in communication with, or integrated into, a knitting machine.

Generally, knitting process 900 may be described with reference to three sub-processes that are used to form different portions of the knitted component. In an exemplary embodiment, knitting process 900 may include a first sub-process 910 for forming a first side portion of a knitted component, a second sub-process 920 for forming a tongue portion of a knitted component, and a third sub-process 930 for forming a second side portion of a knitted component. As described herein, each sub-process may further include a series of method steps or additional processes directed towards forming the relevant portion of the knitted component. Accordingly, first sub-process 910, second sub-process 920, and third sub-process 930, when taken together, perform the method of exemplary knitting process 900.

In an exemplary embodiment, first sub-process 910 may be directed towards forming a first side portion of a knitted component, including knitted component 130, described above. For example, a first side portion may be a portion of either a medial or lateral side of a knitted component. In this embodiment, first sub-process 910 includes a step 911 of knitting the first side portion, a step 912 of transferring the first side portion to a front needle bed of a knitting machine (described below), and a step 913 of holding the first side portion on the needles of the front bed. The held first side portion will be later joined with an additional portion of the knitted component, as will be described in regard to second sub-process 920, below.

In an exemplary embodiment, second sub-process 920 may be directed towards forming a tongue portion of a knitted component, including gusseted tongue 124 of knitted component 130. In one embodiment, second sub-process 920 may begin after step 913 of first sub-process 910 has been completed. In other embodiments, one or more steps of second sub-process 920 may begin during other steps associated with first sub-process 910 and prior to completion of step 913.

In this embodiment, second sub-process 920 includes a step 921 of knitting a tongue portion. For example, in one embodiment, tongue portion may include gusseted tongue 124, described above. Next, after step 921 of knitting the tongue portion, a step 922 of transferring the tongue portion to the back needle bed of a knitting machine (described below) is performed. Continuing in a step 923, one of the front needle bed or the back needle bed are shifted to the right or left by a predetermined distance that may be measured in terms of units, such as centimeters or inches, or in terms of numbers of needles on the needle bed. Accordingly, at step 923, one of the needle beds is shifted relative to the other needle bed so as to overlap a portion of the first side portion being held on the front bed and a portion of the tongue portion being held on the back bed.

After the needle beds have been shifted relative to each other at step 923, the first side portion from first sub-process 910 may be joined with tongue portion from second sub-process 920 at a step 924. In an exemplary embodiment, the first side portion and tongue portion may be joined by knitting a course on the knitting machine that is continuous with courses from each of the portions, thereby attaching the portions together to form a combined first side and tongue portion. Next, at a step 925, the combined first side and tongue portion is transferred to the back needle bed of a knitting machine, and subsequently held on the back needles at a step 926.

In an exemplary embodiment, third sub-process 930 may be directed towards forming a second side portion of a knitted component, including a portion of the medial or lateral side of knitted component 130. In one embodiment, third sub-process 930 may begin after step 926 of second sub-process 920 has been completed. In other embodiments, one or more steps of third sub-process 930 may begin during other steps associated with second sub-process 920 and prior to completion of step 926.

In this embodiment, third sub-process 930 includes a step 931 of knitting a second side portion. For example, if the first side portion forms a portion of the lateral side of a knitted component, the second side portion will form a portion of the opposite medial side of the knitted component. Next, after step 931, a step 932 of transferring the second side portion to the front needle bed of a knitting machine is performed. Continuing in a step 933, one of the front needle bed or the back needle bed are shifted to the right or left by a predetermined distance, as described above. Accordingly, at step 933, one of the needle beds is shifted relative to the other needle bed so as to overlap a portion of the second side portion being held on the front bed and a portion of the combined first side and tongue portion being held on the back bed from step 926.

After the needle beds have been shifted relative to each other at step 933, the combined first side and tongue portion from second sub-process 920 may be joined with the second side portion from third sub-process 930 at a step 934. In an exemplary embodiment, the combined first side and tongue portion and the second side portion may be joined by knitting a course on the knitting machine that is continuous with courses from each of the portions, thereby attaching the portions together to form the knitted component as a one-piece element. Finally, at a step 935, the remaining portion of the knitted component is continued until the entire knitted component has been completed.

Figure 11:
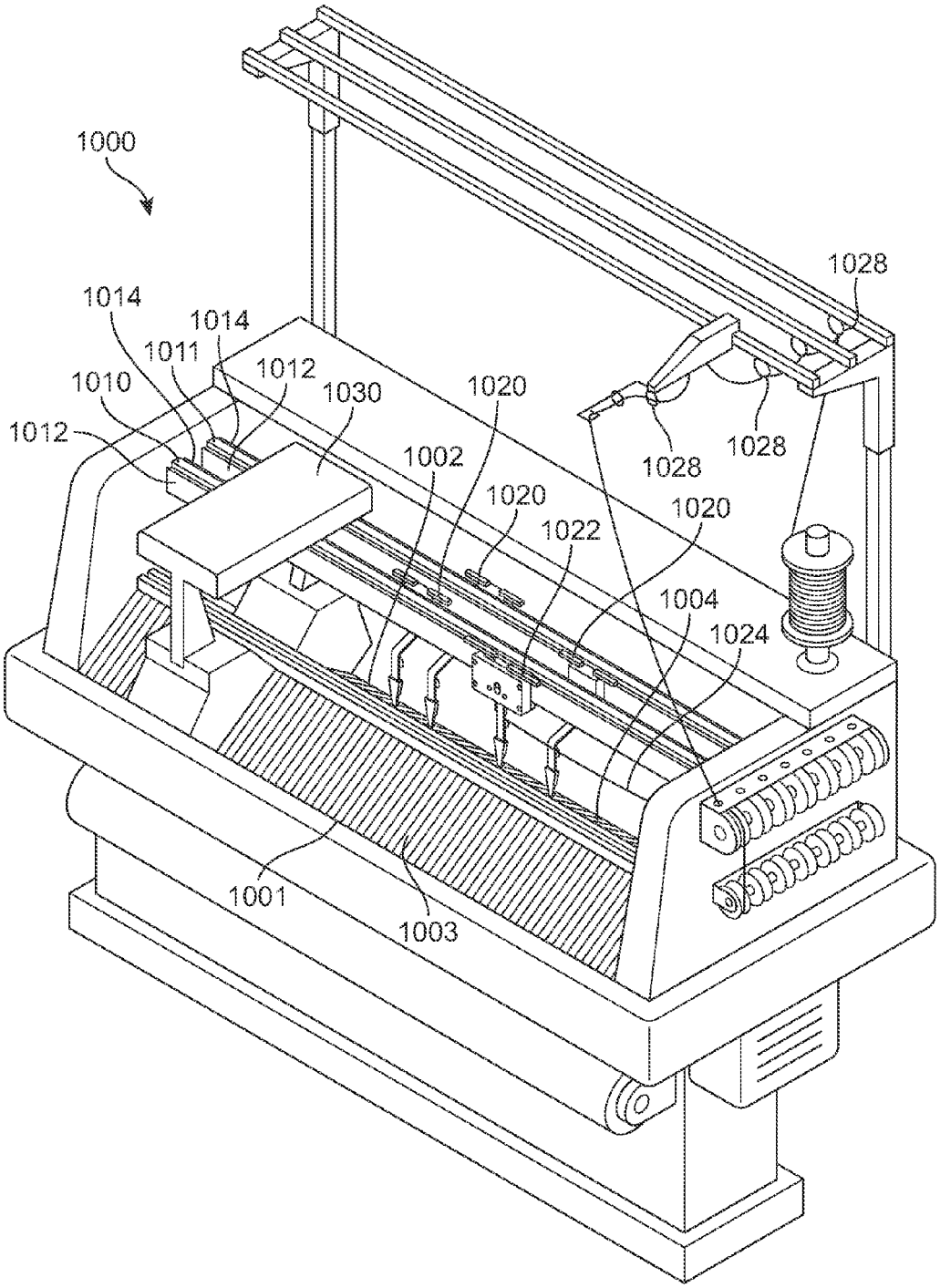
FIG. 11 is an isometric view of an exemplary embodiment of a knitting machine.

Although knitting may be performed by hand, the commercial manufacture of knitted components is generally performed by knitting machines. FIG. 11 illustrates an exemplary embodiment of a knitting machine 1000 that is suitable for producing any of the knitted components described in the previous embodiments, including knitted component 130, as well as other configurations of knitted components not explicitly illustrated or described but made according to the principles described herein. In this embodiment, knitting machine 1000 has a configuration of a V-bed flat knitting machine for purposes of example, but any of the knitted components or portions of knitted components may be produced on other types of knitting machines.

In an exemplary embodiment, knitting machine 1000 may include two needle beds, including a front needle bed 1001 and a back needle bed 1002, that are angled with respect to each other, thereby forming a V-bed. Each of front needle bed 1001 and back needle bed 1002 include a plurality of individual needles that lay on a common plane, including needles 1003 associated with front bed 1001 and needles 1004 associated with back bed 1002. That is, needles 1003 from front needle bed 1001 lay on a first plane, and needles 1004 from back needle bed 1002 lay on a second plane. The first plane and the second plane (i.e., the two needle beds 1001, 1002) are angled relative to each other and meet to form an intersection that extends along a majority of a width of knitting machine 1000. As described in greater detail below, needles 1003, 1004 each have a first position where they are retracted and a second position where they are extended. In the first position, needles 1003, 1004 are spaced from the intersection where the first plane and the second plane meet. In the second position, however, needles 1003, 1004 pass through the intersection where the first plane and the second plane meet.

A pair of rails, including a forward rail 1010 and a rear rail 1011, extends above and parallel to the intersection of needle beds 1001, 1002 and provide attachment points for multiple standard feeders 1020 and combination feeders 1022. Each rail 1010, 1011 has two sides, each of which accommodates either one standard feeder 1020 or one combination feeder 1022. In this embodiment, rails 1010, 1011 include a front side 1012 and a back side 1014. As such, knitting machine 1000 may include a total of four feeders 1020 and 1022. As depicted, the forward-most rail, forward rail 1010, includes one combination feeder 1022 and one standard feeder 1020 on opposite sides, and the rearward-most rail, rear rail 1011, includes two standard feeders 1020 on opposite sides. Although two rails 1010, 1011 are depicted, further configurations of knitting machine 1000 may incorporate additional rails to provide attachment points for more standard feeders 1020 and/or combination feeders 1022.

Due to the action of a carriage 1030, feeders 1020 and 1022 move along rails 1010, 1011 and needle beds 1001, 1002, thereby supplying yarns to needles 1003, 1004. As shown in FIG. 11, a yarn 1024 is provided to combination feeder 1022 by a spool 1026. More particularly, yarn 1024 extends from spool 1026 to various yarn guides 1028, a yarn take-back spring, and a yarn tensioner before entering combination feeder 1022. Although not depicted, additional spools may be used to provide yarns to feeders 1020 in a substantially similar manner as spool 1026.

Standard feeders 1020 are conventionally-used for a V-bed flat knitting machine, such as knitting machine 1000. That is, existing knitting machines incorporate standard feeders 1020. Each standard feeder 1020 has the ability to supply a yarn that needles 1003, 1004 manipulate to knit, tuck, and float. As a comparison, combination feeder 1022 has the ability to supply a yarn (e.g., yarn 1024) that needles 1003, 1004 knit, tuck, and float, and combination feeder 1022 further has the ability to inlay the yarn. Moreover, combination feeder 1022 has the ability to inlay a variety of different tensile elements, including yarn or other types of strands (e.g., filament, thread, rope, webbing, cable, or chain). Accordingly, combination feeder 1022 exhibits greater versatility than each standard feeder 1020.

Standard feeders 1020 and combination feeder 1022 may have substantially similar configurations as the structure of standard feeders and the combination feeder described in the Inlaid Strand cases, the disclosure of which has been incorporated by reference above.

The manner in which knitting machine 1000 operates to manufacture a knitted component will now be discussed in detail. Moreover, the following discussion will demonstrate the operation of one or more standard feeders 1020 and/or combination feeders 1022 during a knitting process. The knitting process discussed herein relates to the formation of various knitted components, which may be any knitted component, including knitted components that are similar to knitted components in the embodiments described above. For purposes of the discussion, only a relatively small section of a knitted component may be shown in the figures in order to permit the knit structure to be illustrated. Moreover, the scale or proportions of the various elements of knitting machine 1000 and a knitted component may be enhanced to better illustrate the knitting process. It should be understood that although a knitted component is formed between needle beds 1001, 1002, for purposes of illustration in FIGS. 12 through 20, a knitted component is shown adjacent to needle beds 1001, 1002 to (a) be more visible during discussion of the knitting process and (b) show the position of portions of the knitted component relative to each other and needle beds 1001, 1002. Also, although one rail, and limited numbers of standard feeders and/or combination feeders are depicted, additional rails, standard feeders, and combination feeders may be used. Accordingly, the general structure of knitting machine 1000 is simplified for purposes of explaining the knitting process.

Additionally, for purposes of illustration of the exemplary knitting process 900 used to form knitted component 130 with gusseted tongue 124, illustrated in FIGS. 1-6 above, inlaid strand 132 disposed within knit element 131 has been omitted. However, it should be understood that a knitted component formed according to the exemplary knitting process 900 may include inlaid strand 132 using combination feeder 1022, as described in the Inlaid Strand cases, the disclosure of which has been incorporated by reference above.

Figure 12:
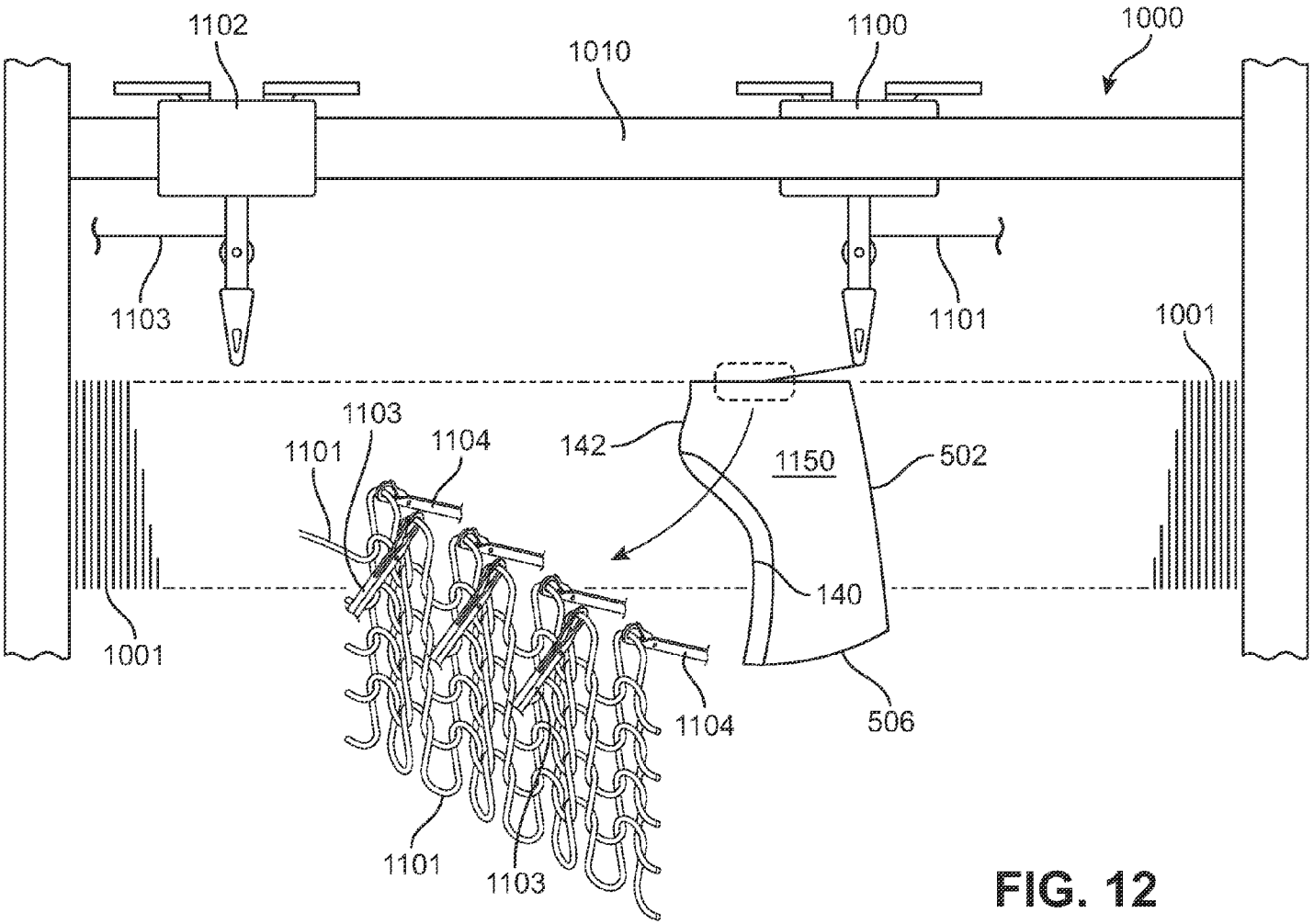
FIG. 12 is a schematic view of internal components of the knitting machine in operation to manufacture a first side portion of a knitted component.

FIGS. 12 through 20 illustrate a detailed schematic view of steps associated with knitting process 900 for knitting a knitted component in the form of knitted component 130 having gusseted tongue 124, described above. Referring to FIG. 12, a portion of knitting machine 1000 that includes needles 1003 associated with front needle bed 1001, needles 1004 associated with back needle bed 1002, and forward rail 1010 is shown. Additionally, in this embodiment, knitting machine 1000 may include a first standard feeder 1100 and a second standard feeder 1102 that are substantially similar to standard feeder 1020, described above. First standard feeder 1100 may be secured to a rear side of front rail 1010 and second standard feeder 1102 may be secured to a front side of front rail 1010. In other embodiments, additional feeders may be used and may be located on the front or rear side of front rail 1010 and/or rear rail 1011.

In this embodiment, a first yarn 1101 from a spool (not shown) passes through first standard feeder 1100 and an end of yarn 1101 extends outward from a dispensing tip at the end of first standard feeder 1100. Although yarn 1101 is depicted, any other strand (e.g., filament, thread, rope, webbing, cable, chain, or yarn) may pass through first standard feeder 1100. A second yarn 1103 similarly passes through second standard feeder 1102 and extends outward from a dispensing tip. In an exemplary embodiment, first yarn 1101 and second yarn 1103 may be used to form portions of knitted component 130. In this embodiment, loops of first yarn 1101 are shown forming an uppermost course of a first side portion 1150 of knitted component 130 and are held by hooks located on ends of needles 1003 and needles 1004. As shown in FIG. 12, first side portion 1150 is a portion of knitted component 130 that includes lateral heel edge 506 and a portion of lateral side perimeter edge 502 on the outer perimeter and a portion of collar 140 and lateral inner edge 142 on the inner perimeter. Accordingly, FIG. 12 corresponds to a schematic view of step 911 of first sub-process 910 of knitting process 900, described above.

Figure 13:
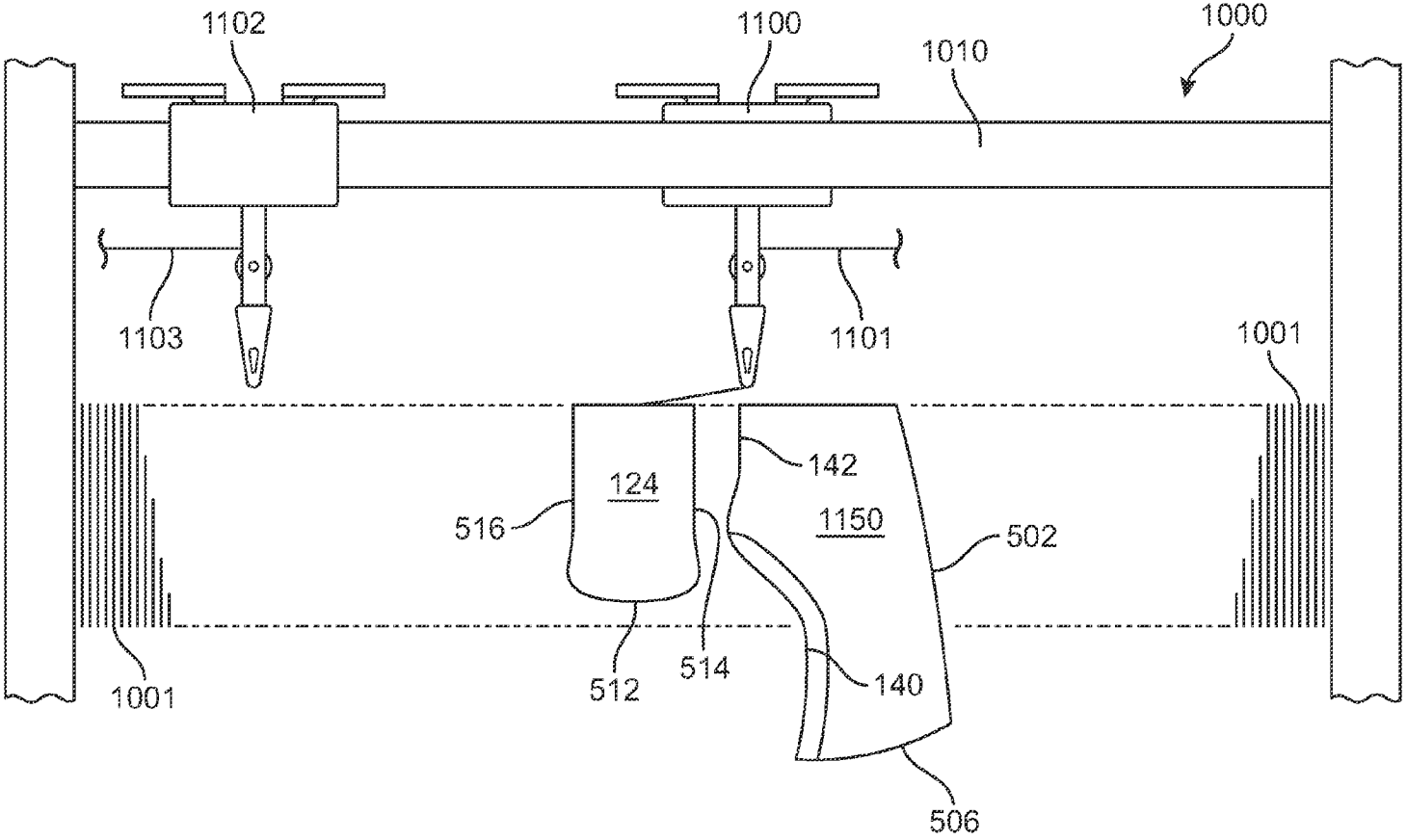
FIG. 13 is a schematic view of internal components of the knitting machine in operation to manufacture a tongue portion of a knitted component.
Figure 14:
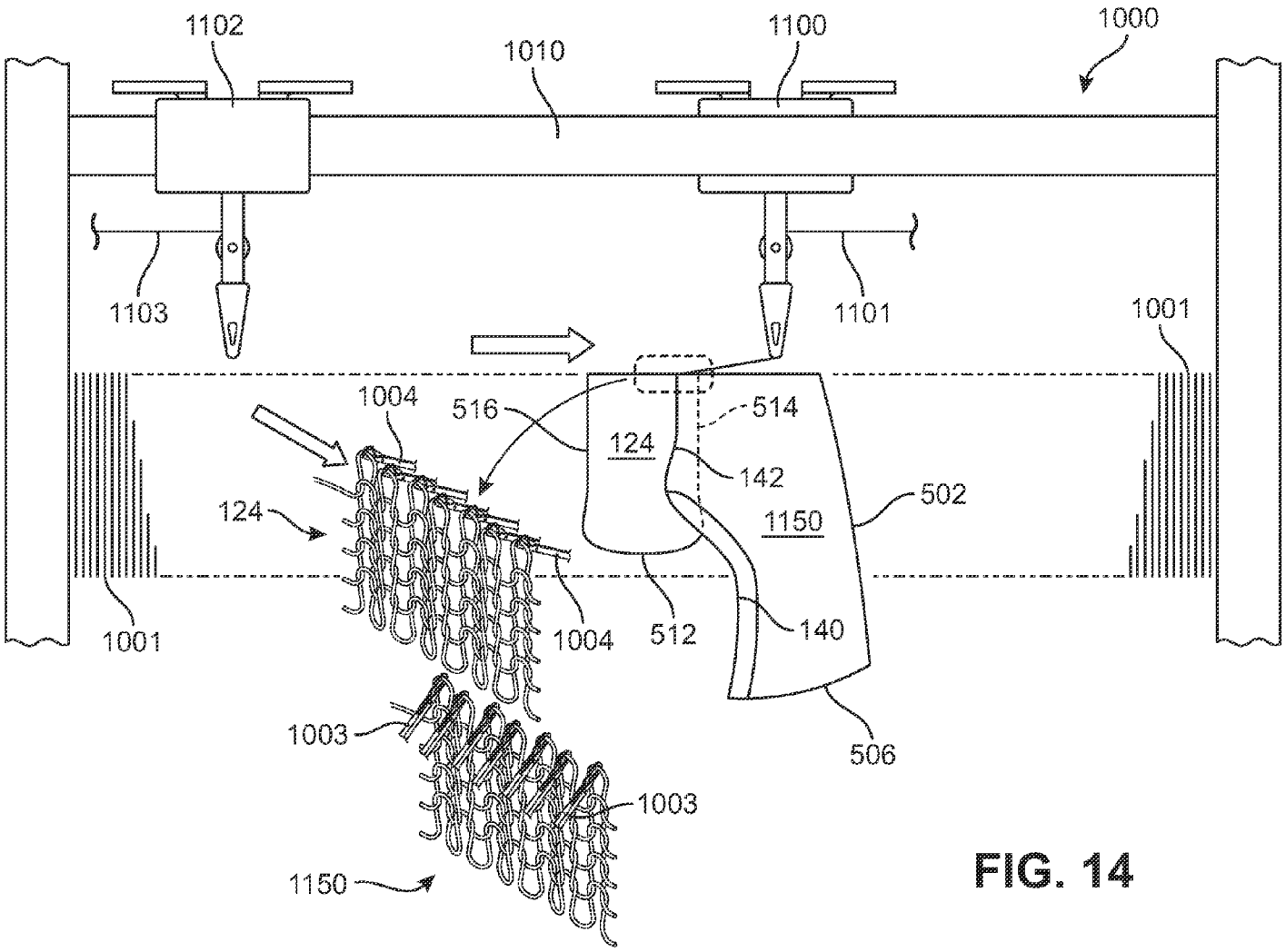
FIG. 14 is a schematic view of internal components of the knitting machine in operation to join a first side portion and a tongue portion of a knitted component.

Referring now to FIG. 13, a schematic view that corresponds to step 921 of second sub-process 920 of knitting process 900 is illustrated. In this embodiment, loops of first yarn 1101 are shown forming gusseted tongue 124 of knitted component 130. Additionally, first side portion 1150 is shown being held by needles 1003 of front bed 1001. Next, FIG. 14 illustrates a schematic view that corresponds to step 923 of second sub-process 920. In this embodiment, back bed 1002 is shown being shifted by a predetermined distance relative to front bed 1001. As shown in FIG. 14, first side portion 1150 is being held by needles 1003 associated with front bed 1001, while gusseted tongue 124 is being held by needles 1004 associated with back bed 1002. Accordingly, when back bed 1002 is shifted by a predetermined distance relative to front bed 1001, a portion of first side portion 1150 and a portion of gusseted tongue 124 will overlap each other.

Figure 15A:
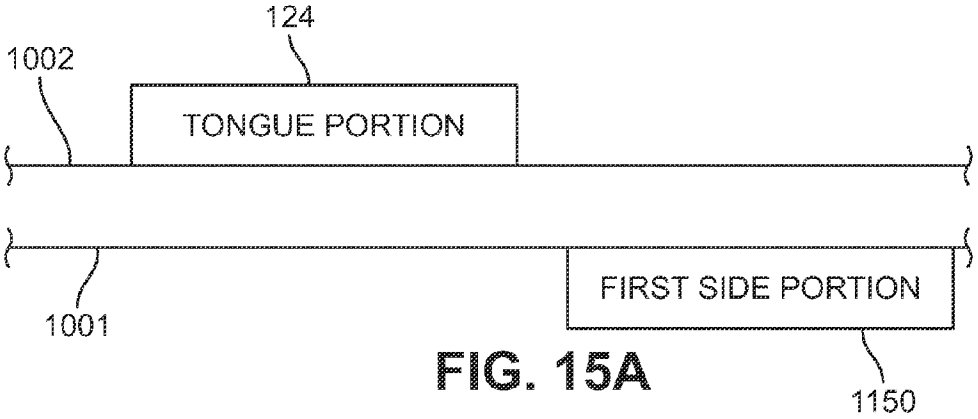
FIG. 15A is a representational view of needle beds of the knitting machine in a first position during operation to join the first side portion and the tongue portion.
Figure 15B:
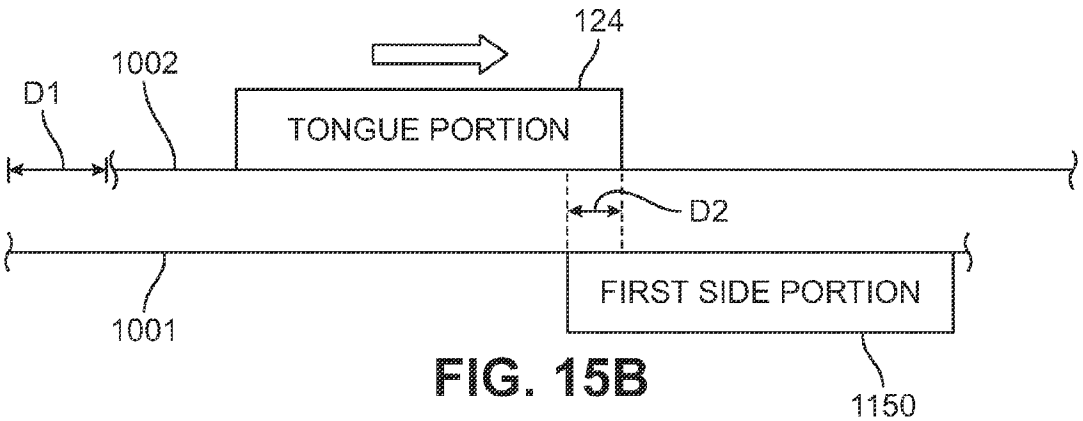
FIG. 15B is a representational view of needle beds of the knitting machine in a second position during operation to join the first side portion and the tongue portion.

FIGS. 15A and 15B illustrate a representational top view of the process of step 923 illustrated by FIG. 14. As shown in FIG. 15A, prior to step 923 of second sub-process 920, first side portion has been transferred to needles 1003 associated with front bed 1001 at step 912 and gusseted tongue portion 124 has been transferred to opposite needles 1004 associated with back bed 1002. Therefore, in the configuration of knitting machine 1000 shown in FIG. 15A, each portion, gusseted tongue portion 124 and first side portion 1150, are held on different needle beds. In addition, in this embodiment, gusseted tongue portion 124 and first side portion 1150 may be initially separated from each other in the lateral direction by a distance that corresponds to a measurement in units, such as centimeters or inches, or in terms of numbers of needles on the needle bed.

Next, as shown in FIG. 15B, needle beds 1001, 1002 are shifted relative to each other during step 923. In this embodiment, back bed 1002 is shown being shifted by a first distance D1 to the right relative to front bed 1001. In other embodiments, however, front bed 1001 may instead be shifted relative to back bed 1002. In some embodiments, the shifting of needle beds 1001, 1002 causes portions of the separate components being held on each of front bed 1001 and back bed 1002 to overlap with one another. For example, as shown in FIG. 15B, by shifting back bed 1002 first distance D1 to the right relative to front bed 1001, gusseted tongue portion 124 on back bed 1002 is moved so as to overlap with a portion of first side portion 1150 on front bed 1001. In an exemplary embodiment, gusseted tongue portion 124 may overlap with first side portion 1150 by a second distance D2. In this embodiment, second distance D2 is less than first distance D1 associated with the shift of back bed 1002. The difference between second distance D2 and first distance D1 is the result in the initial separation between gusseted tongue portion 124 and first side portion 1150 shown in FIG. 15A. In one embodiment, first distance D1 may be approximately 10-20 needles. In other embodiments, first distance D1 may be larger or smaller, or may be measured in units, such as centimeters or inches. In some cases, the value of first distance D1 may be determined as a function of the limits of the knitting machine or by the spacing of feeders on the rails of the knitting machine.

Additionally, in an exemplary embodiment, second distance D2 may correspond with the width of the overlapping portions of gusseted tongue 124 and knit element 131. For example, in this embodiment, second distance D2 may be substantially equal to second width W2 of the portion of gusseted tongue 124 adjacent to lateral side edge 514 that is overlapped by knit element 131, described above.

Figure 16:
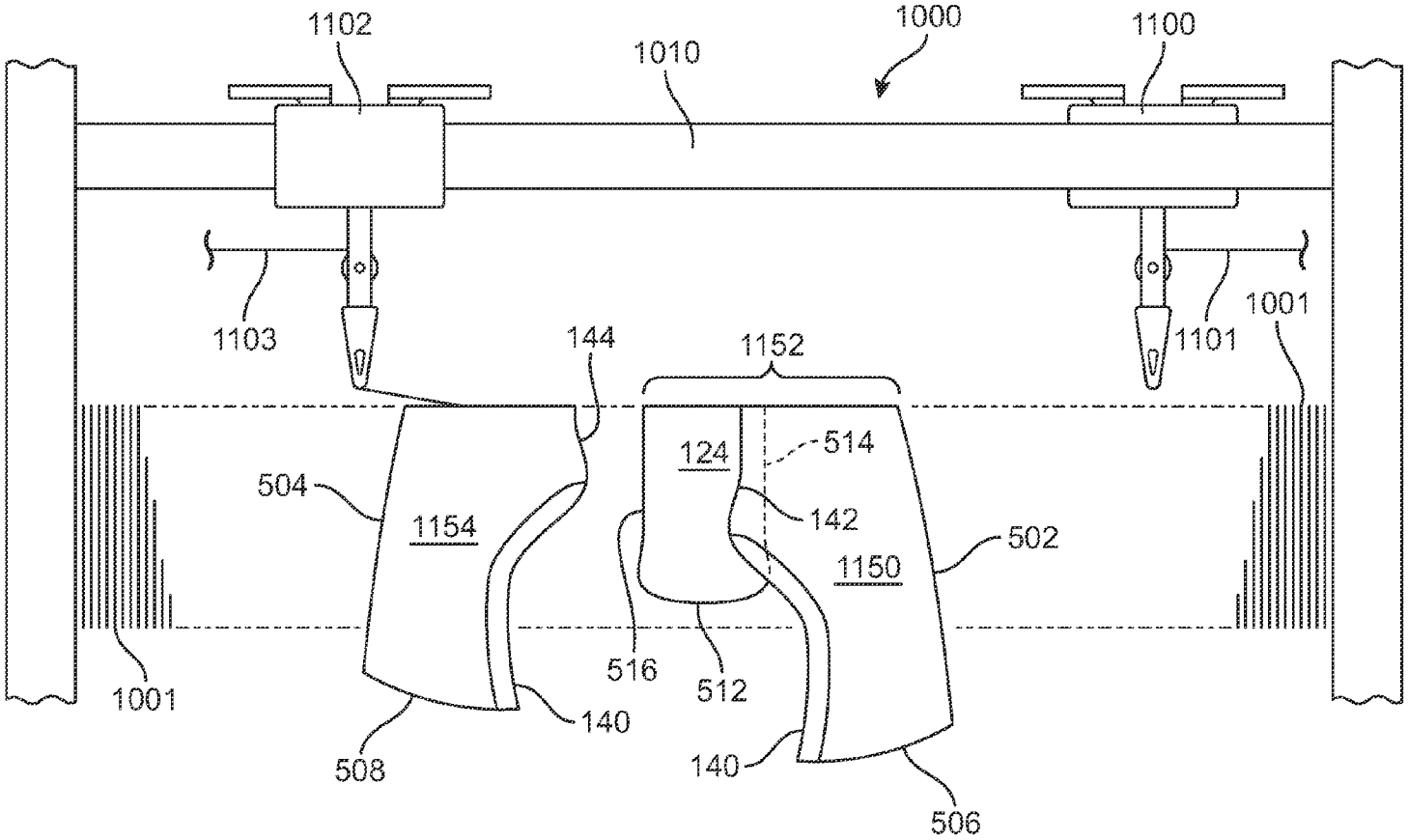
FIG. 16 is a schematic view of internal components of the knitting machine in operation to manufacture a second side portion of a knitted component.

Referring now to FIG. 16, a schematic view that corresponds to step 931 of third sub-process 930 of knitting process 900 is illustrated. In this embodiment, loops of second yarn 1103 from second standard feeder 1102 are shown forming a second side portion 1154 of knitted component 130. As shown in FIG. 16, second side portion 1154 is a portion of knitted component 130 that includes medial heel edge 508 and a portion of medial side perimeter edge 504 on the outer perimeter and a portion of collar 140 and medial inner edge 144 on the inner perimeter.

Additionally, gusseted tongue 124 and first side portion 1150 have been previously joined together to form a combined first side and tongue portion 1152 at step 924 of second sub-process 920. In FIG. 16, combined first side and tongue portion 1152 is shown being held by hooks located on ends of needles 1004 of back bed 1002 after being transferred in step 925. It should be noted that while in FIG. 16 second conventional feeder 1102 is shown knitting second side portion 1154, in other embodiments, only a single conventional feeder may be used during knitting process 900 to form knitted component 130.

Figure 17:
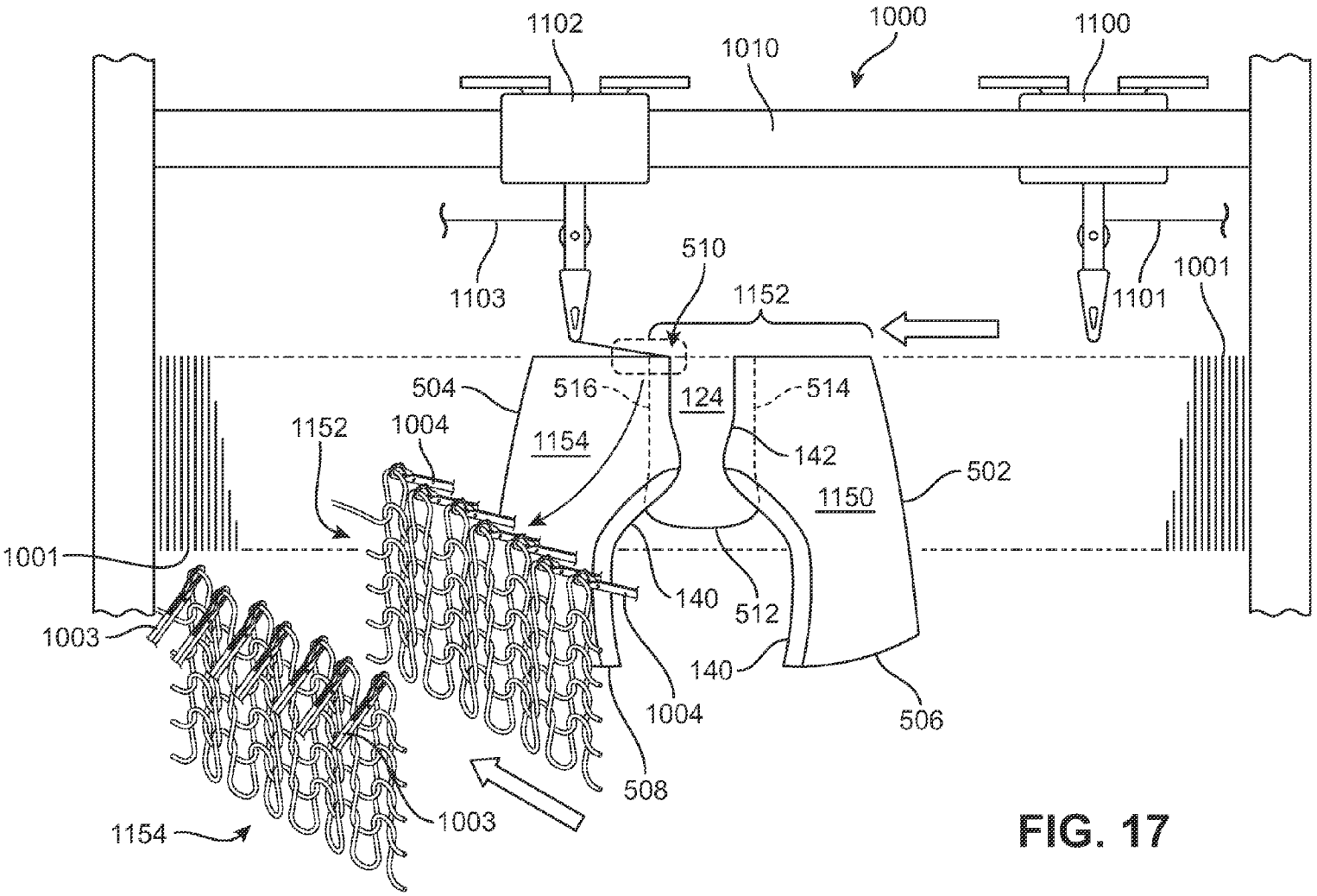
FIG. 17 is a schematic view of internal components of the knitting machine in operation to join a second side portion with a combined first side and tongue portion of a knitted component.

Next, FIG. 17 illustrates a schematic view that corresponds to step 933 of third sub-process 930. In this embodiment, back bed 1002 is shown being shifted by a predetermined distance relative to front bed 1001. As shown in FIG. 17, second side portion 1154 is being held by needles 1003 associated with front bed 1001, while combined first side and tongue portion 1152 is being held by needles 1004 associated with back bed 1002. Accordingly, when back bed 1002 is shifted by a predetermined distance relative to front bed 1001, a portion of second side portion 1154 and a portion of combined first side and tongue portion 1152 will overlap each other.

Figure 18A:
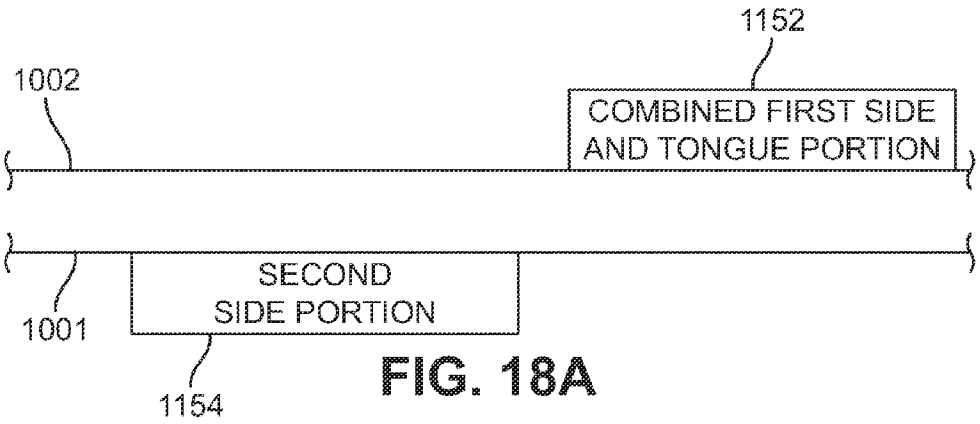
FIG. 18A is a representational view of needle beds of the knitting machine in a first position during operation to join the second side portion with the combined first side and tongue portion.
Figure 18B:
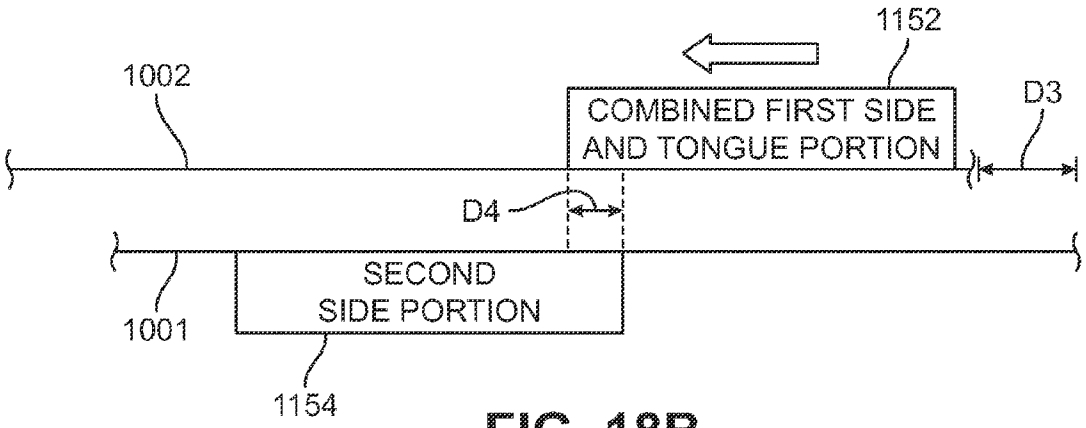
FIG. 18B is a representational view of needle beds of the knitting machine in a second position during operation to join the second side portion with the combined first side and tongue portion.

FIGS. 18A and 18B illustrate a representational top view of the process of step 933 illustrated by FIG. 17. As shown in FIG. 18A, prior to step 933 of third sub-process 930, second side portion 1154 has been transferred to needles 1003 associated with front bed 1001 at step 932 and combined first side and tongue portion 1152 has been transferred to opposite needles 1004 associated with back bed 1002. Therefore, in the configuration of knitting machine 1000 shown in FIG. 18A, each portion, second side portion 1154 and combined first side and tongue portion 1152, are held on different needle beds. In addition, in this embodiment, second side portion 1154 and combined first side and tongue portion 1152 may be initially separated from each other in the lateral direction by a distance that corresponds to a measurement in units, such as centimeters or inches, or in terms of numbers of needles on the needle bed.

Next, as shown in FIG. 18B, needle beds 1001, 1002 are shifted relative to each other during step 933. In this embodiment, back bed 1002 is shown being shifted by a third distance D3 to the left relative to front bed 1001. In other embodiments, however, front bed 1001 may instead be shifted relative to back bed 1002. In some embodiments, the shifting of needle beds 1001, 1002 causes portions of the separate components being held on each of front bed 1001 and back bed 1002 to overlap with one another. For example, as shown in FIG. 18B, by shifting back bed 1002 third distance D3 to the left relative to front bed 1001, combined first side and tongue portion 1152 on back bed 1002 is moved so as to overlap with a portion of second side portion 1154 on front bed 1001. In an exemplary embodiment, the portion of second side portion 1154 including medial inner edge 144 overlaps with a portion of gusseted tongue 124 along medial side edge 516.

In an exemplary embodiment, gusseted tongue portion 124 may overlap with second side portion 1154 by a fourth distance D4. In this embodiment, fourth distance D4 is less than third distance D3 associated with the shift of back bed 1002. The difference between fourth distance D4 and third distance D3 is the result in the initial separation between second side portion 1154 and combined first side and tongue portion 1152 shown in FIG. 18A. In one embodiment, third distance D3 may be approximately 10-20 needles. In other embodiments, third distance D3 may be larger or smaller, or may be measured in units, such as centimeters or inches. In some cases, the value of third distance D3 may be determined as a function of the limits of the knitting machine or by the spacing of feeders on the rails of the knitting machine.

Additionally, in an exemplary embodiment, fourth distance D4 may correspond with the width of the overlapping portions of gusseted tongue 124 and knit element 131. For example, in this embodiment, fourth distance D4 may be substantially equal to third width W3 of the portion of gusseted tongue 124 adjacent to medial side edge 516 that is overlapped by knit element 131, described above.

Figure 19:
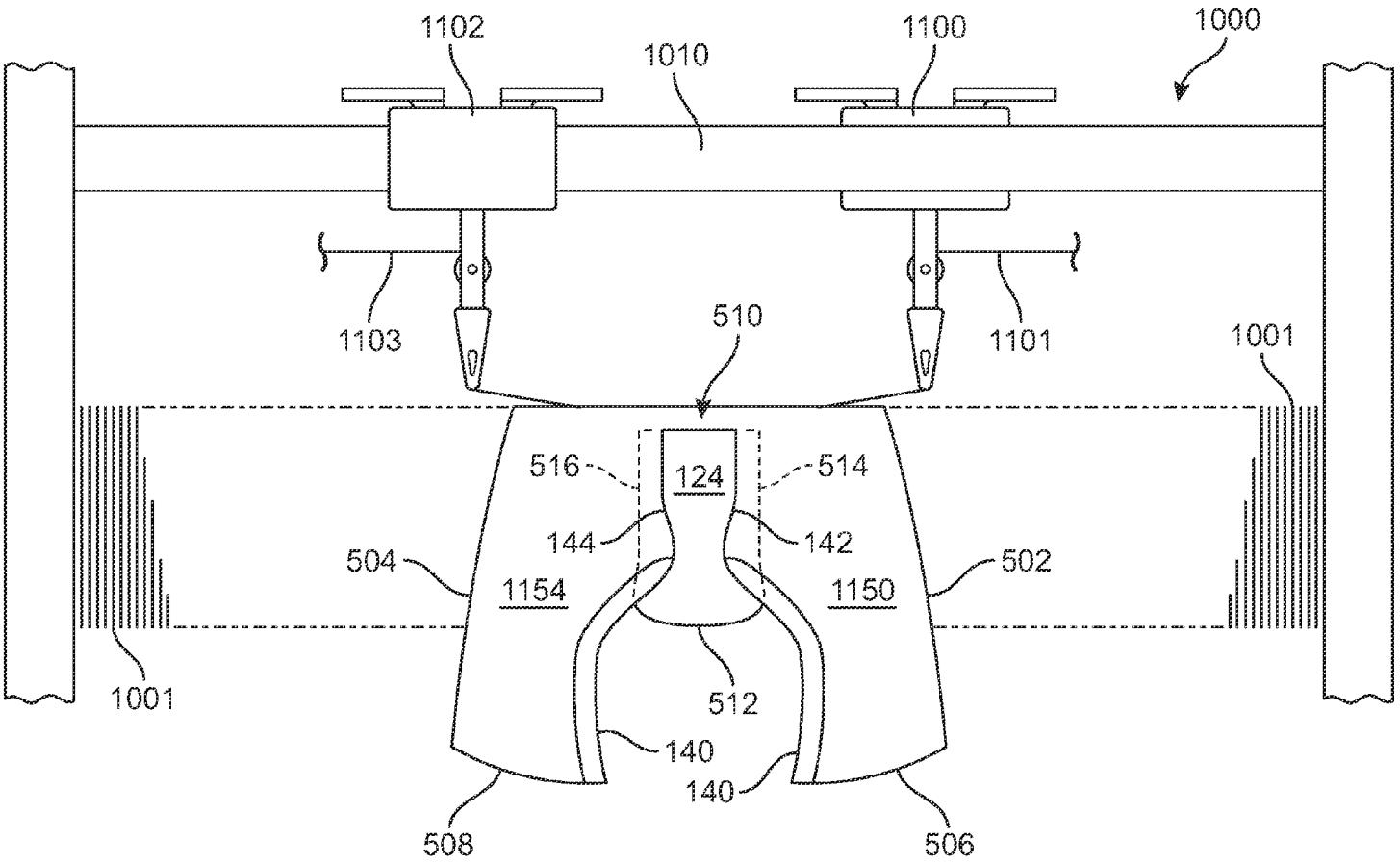
FIG. 19 is a schematic view of internal components of the knitting machine in operation to manufacture a knitted component including a gusseted tongue.

Referring now to FIG. 19, a schematic view that corresponds to just after step 934 of third sub-process 930 is illustrated. As described above, after shifting needle beds 1001, 1002 in step 933, second side portion 1154 and combined first side and tongue portion 1152 are joined by knitting a course on knitting machine 1000 that is continuous with courses from each of second side portion 1154 and combined first side and tongue portion 1152, thereby attaching second side portion 1154 and combined first side and tongue portion 1152 together to form the knitted component as a one-piece element. With this process completed, gusseted tongue 124 is joined to knit element 131 along forward portion 510, as described in detail above.

Figure 20:
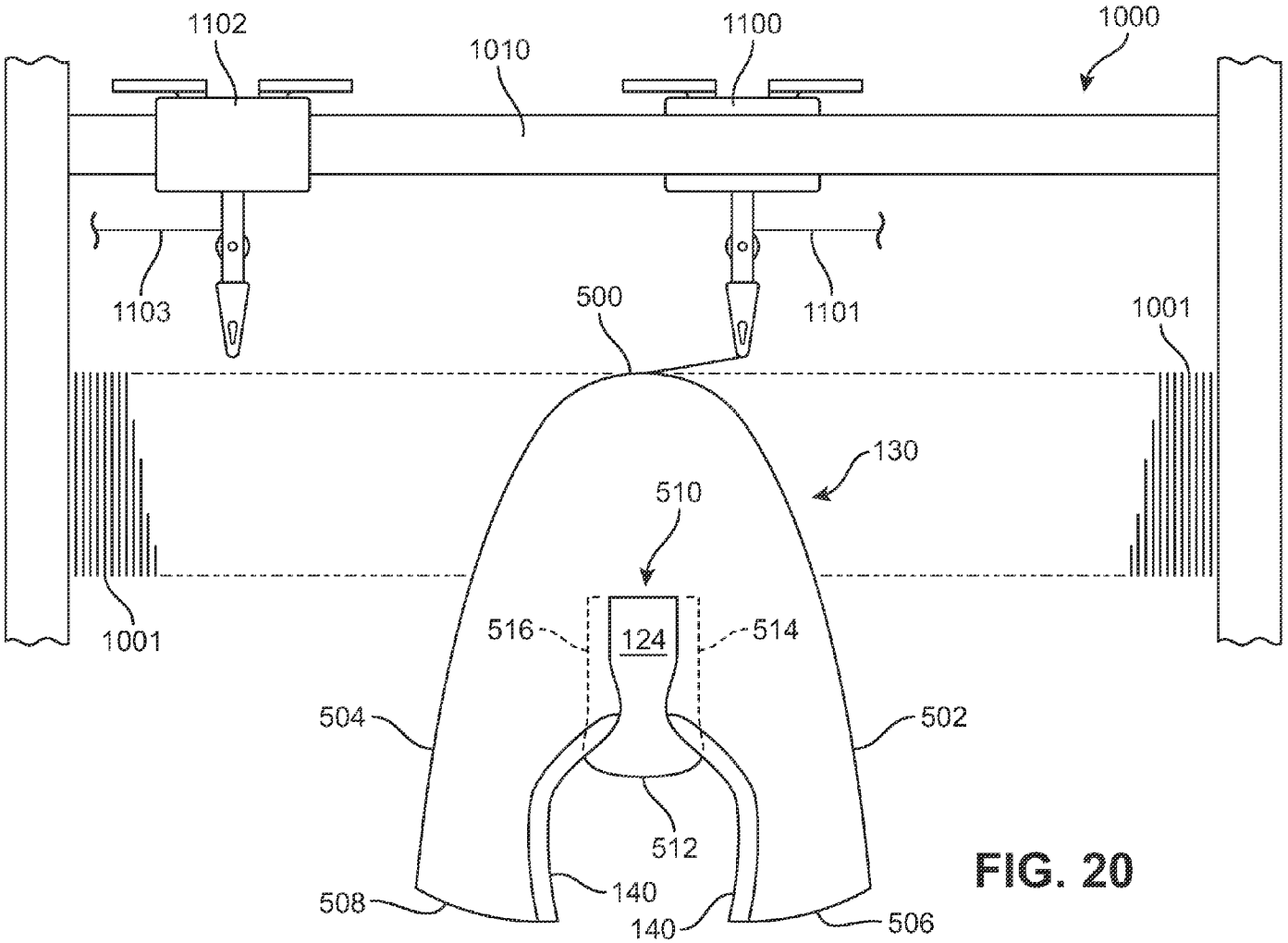
FIG. 20 is a schematic view of internal components of the knitting machine in operation to complete manufacture of a knitted component including a gusseted tongue.

Finally, FIG. 20 illustrates a schematic view that corresponds to step 935 of third sub-process 930. In this embodiment, additional courses of knitted component 130 are knit on knitting machine 1000 in a conventional manner. With this process, the remaining portion of knitted component 130 is continued until the entire knitted component 130 has been completed.

The processes and methods for knitting a knitted component described above and illustrated in FIGS. 10 through 20 are exemplary and are not meant to be exhaustive. Therefore, it should be understood that additional knitted components including the features of the embodiments described herein, as well as similar knitted components not explicitly described herein, may be made using one or more knitting processes that are substantially similar to the knitting methods for knitted components described above and/or in the Inlaid Strands cases.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of manufacturing a knitted component, the method comprising:

knitting a first portion of the knitted component with a knitting machine; knitting a second portion of the knitted component with the knitting machine; transferring the first portion to a first set of needles associated with a first needle bed of the knitting machine;

transferring the second portion to a second set of needles associated with a second needle bed of the knitting machine, the second needle bed being disposed opposite the first needle bed on the knitting machine;

shifting at least one of the first needle bed and the second needle bed in a lateral direction relative to the other, thereby causing at least a portion of the first portion and a portion of the second portion to overlap;

knitting at least one course of the knitted component with the knitting machine to join the overlapped first portion and second portion to form a combined portion; and wherein the first portion and the second portion are configured to form at least a portion of an upper of an article of footwear, and wherein the first portion is a portion of at least one of a medial and a lateral side of the upper; and wherein the second portion is a portion of at least one of a tongue and an opposite medial side or lateral side to the first portion.

2. The method recited in claim 1, the method further comprising the step of knitting a remaining portion of the knitted component with the knitting machine after the step of joining the overlapped first portion and second portion to form the combined portion.

3. The method recited in claim 2, wherein the step of knitting the remaining portion of the knitted component further comprises the steps of:

knitting a third portion of the knitted component with the knitting machine;

transferring the third portion to the first set of needles associated with the first needle bed of the knitting machine;

transferring the combined portion to the second set of needles associated with the second needle bed of the knitting machine;

shifting at least one of the first needle bed and the second needle bed in a lateral direction relative to the other, thereby causing at least a portion of the third portion and a portion of the combined portion to overlap; and knitting at least one course of the knitted component with the knitting machine to join the overlapped third portion and combined portion.

4. The method recited in claim 1, wherein the at least one of the first needle bed and the second needle bed is shifted in the lateral direction relative to the other by a first distance; and wherein the portion of the first portion and the portion of the second portion overlap by a second distance.

5. The method recited in claim 4, wherein the second distance is smaller than the first distance.

6. The method recited in claim 4, wherein the first distance is between 10 to 20 needles.

7. The method recited in claim 1, wherein the step of knitting the second portion is performed after the step of transferring the first portion to the first set of needles.

8. A method of manufacturing a knitted component, the method comprising:

knitting a first portion of a knit element with a knitting machine;

holding the first portion on needles of one of a first needle bed and an opposite second needle bed of the knitting machine;

knitting a second portion of the knit element with the knitting machine while the first portion of the knit element is held on the needles;

shifting needles of the first needle bed on the knitting machine in a first lateral direction relative to the second needle bed;

joining the first portion and the second portion to form a combined portion while the needles are shifted;

holding the combined portion on the needles of one of the first needle bed and the second needle bed of the knitting machine;

knitting a third portion of the knit element with the knitting machine while the combined portion is held on the needles;

shifting needles of the first needle bed on the knitting machine in a second lateral direction relative to the second needle bed;

joining the third portion and the combined portion while the needles are shifted to form the knitted component; and wherein the first portion is configured to form one of a lateral side and a medial side of an upper of an article of footwear and wherein the third portion is configured to form the opposite medial side or lateral side to the first portion; and wherein the second portion is a tongue that is joined to the knit element at a forward portion disposed between the lateral side and medial side of the upper of the article of footwear.

9. The method recited in claim 8, further including a step of selecting the knitting machine to be a flat knitting machine.

10. The method recited in claim 8, wherein at least a portion of the first portion and at least a portion of the third portion overlap the second portion to provide an overlapping configuration on the knitted component.

11. The method recited in claim 10, wherein the overlapping configuration comprises at least two knitted layers.

12. The method recited in claim 10, wherein the overlapping configuration comprises at least four knitted layers.

13. The method recited in claim 8, further comprising a step of transferring the first portion to needles of one of the first needle bed and the second needle bed; and a step of transferring the second portion to needles on the opposite needle bed from the first portion.

14. The method recited in claim 8, wherein the first lateral direction and the second lateral direction are opposite.

15. The method recited in claim 8, wherein the step of joining the first portion and the second portion to form the combined portion includes forming a course with the knitting machine that joins a course of the first portion and a course of the second portion.

16. The method recited in claim 15, wherein the step of joining the third portion and the combined portion includes forming a course with the knitting machine that joins a course of the combined portion with a course of the third portion.

17. The method recited in claim 8, wherein the first portion is formed using a first yarn type and the second portion is formed using a second yarn type, the second yarn type being different than the first yarn type.

* * * * *